US005641613A

United States Patent [19]

Boff et al.

[11] Patent Number: 5,641,613

[45] Date of Patent: Jun. 24, 1997

[54] PHOTOGRAPHIC ELEMENT CONTAINING AN AZOPYRAZOLONE MASKING COUPLER EXHIBITING IMPROVED KEEPING

[75] Inventors: Jane Sarah Boff, St. Albans, England; Stephen Paul Singer, Spencerport, N.Y.

[73] Assignee: Eastman Kodak Company, Rochester, N.Y.

[21] Appl. No.: 591,122

[22] Filed: Jan. 25, 1996

Related U.S. Application Data

[63] Continuation of Ser. No. 276,744, Jul. 18, 1994, abandoned, which is a continuation-in-part of Ser. No. 129,915, Sep. 30, 1993, abandoned.

[51] Int. Cl.[6] ..... G03C 7/305; G03C 7/333; G03C 7/38; G03C 7/384

[52] U.S. Cl. ..... 430/359; 430/362; 430/382; 430/386; 430/387; 430/544; 430/549; 430/555; 430/557; 430/558; 430/563

[58] Field of Search ..... 430/544, 549, 430/555, 557, 558, 563, 359, 362, 382, 386, 387

[56] References Cited

U.S. PATENT DOCUMENTS

| | | | |
|---|---|---|---|
| 4,777,123 | 10/1988 | Yamada et al. | 430/505 |
| 4,977,072 | 12/1990 | Renner et al. | 430/549 |
| 5,219,719 | 6/1993 | Kida | 430/549 |
| 5,270,156 | 12/1993 | Hirabayashi et al. | 430/505 |

FOREIGN PATENT DOCUMENTS 0232101 8/1987 European Pat. Off. .

*Primary Examiner*—Lee C. Wright
*Attorney, Agent, or Firm*—Arthur E. Kluegel

[57] ABSTRACT

The invention provides a photographic element comprising a support bearing a light-sensitive photographic silver halide layer containing (1) a bicyclic azole coupler (2) an azopyrazolone masking coupler and (3) a low impact development inhibitor releasing (LIDIR) coupler having at least one hydrogen atom at the coupling site and which does not substantially reduce contrast in the layer in which it is coated.

20 Claims, No Drawings

PHOTOGRAPHIC ELEMENT CONTAINING AN AZOPYRAZOLONE MASKING COUPLER EXHIBITING IMPROVED KEEPING

CROSS-REFERENCE TO RELATED APPLICATION

This is a Continuation of application Ser. No. 08/276,744, filed Jul. 18, 1994 now abandoned, which is a continuation-in-part of U.S. Ser. No. 08/129,915 filed Sep. 30, 1993 now abandoned.

FIELD OF THE INVENTION

This invention relates to photographic elements containing azopyrazolone masking couplers used to correct for unwanted absorption in color negative film. More particularly, it relates to such elements containing a "low impact" development inhibitor releasing coupler which serves to improve the raw stock keeping without undue degradation in other photographic properties such as fog, contrast, or granularity.

BACKGROUND OF THE INVENTION

The use of 4-phenylazopyrazolone masking couplers is known in the art. See, for example, U.S. Pat. No. 2,455,170; U.S. Pat. No. 2,428,034; U.S. Pat. No. 2,808,329; U.S. Pat. No. 2,434,272; U.S. Pat. No. 2,704,711; U.S. Pat. No. 2,688,539; U.S. Pat. No. 3,796,574; U.S. Pat. No. 3,476,560; U.S. Pat. No. 4,427,763; EP 213,490; and U.S. Pat. No. 4,777,123 as well as those identified in *Research Disclosure* December 1989, Section VII, Part G, Publiched by Kenneth Mason Publications, Ltd., Dudley Annex, 12A North Street, Emworth, Hampshire PO10 7DQ, England. These compounds have proven useful since they are yellow colored in unexposed areas and magenta colored in exposed areas. Thus, when in reality the magenta dye formed in a color negative photographic process has a small but significant unwanted absorption in the blue range, this may be balanced somewhat by the relative loss of blue absorption due to conversion of the mask color from yellow to magenta in the exposed areas. Then, an adjustment can be made to the spectral content of the light used to produce the positive from the negative to effectively cancel out the unwanted blue absorption which is now relatively constant across both the exposed and unexposed areas of the negative.

While 4-phenylazopyrazolone masking couplers have been employed as a means of offsetting the unwanted blue absorption of conventional magenta couplers, this means for improving the color rendition has created several deficiencies in the photographic material related to the raw stock keeping of the element. First, the presence of these masking couplers results in increased fogging (non-imagewise silver development) of the photographic emulsion. This is thought to be due to undesired reactions which occur either in the raw stock prior to development or which occur during the development process itself,either of which results in the formation of a phenyldinitrogen species from the masking coupler. This species can then act as a powerful reducing agent for silver emulsions. The result is undesired non-imagewise silver development which manifests itself as fog. Thus, the Dmin (minimum density) of the photographic material is undesirably increased due to the presence of this class of masking coupler. This deficiency is amplified even further in the case of processing using extended development times ("push" processing.)

The second deficiency with the 4-phenylazopyrazolones is their tendency to degrade the photographic properties when bicyclic azole couplers are employed as image couplers. It is believed that the mentioned phenyldinitrogen species is released as a result of decomposition of the azopyrazolone masking coupler and plays a role in the degradation of the bicyclic azole image coupler during long term storage. This unwanted destruction of the image coupler results in the loss of density in the photographic image because less dye will be formed for a given level of exposure. It is undesirable to have a film where the image will vary with the length of raw stock storage time.

Development inhibitor releasing (DIR) couplers are well known for inclusion in photographic layers for purposes of improving sharpness, color etc. but such compounds substantially reduce the contrast of the layer (e.g. by 60%.) Such a loss in contrast can be unacceptable under various circumstances such as in a layer where coupler starvation is desired to achive the desired low level of granularity.

European Patent Application 232,101 discloses a photographic element containing a pyrazolotriazole coupler together with at least 17 mole % of a colored masking coupler which may be of the azopyrazolone type. The presence of the large relative percentage of the masking coupler is said to improve sharpness and grain, but for the reasons aforesaid, a large increase in the fog would be expected as well. There is no suggestion to include a low impact DIR coupler in the magenta layer containing the mask. U.S. Pat. No. 4,777,123 contains similar general disclosure but again does not suggest use of the low impact DIR coupler in the magenta layer.

A problem to be solved is to provide a photographic element and process where an azopyrazolone masking coupler can be used in combination with a bicyclic azole image coupler without incurring degradation upon keeping.

SUMMARY OF THE INVENTION

The invention provides a photographic element and process employing an element comprising a support bearing a light-sensitive photographic silver halide layer containing (1) a bicyclic azole coupler (2) an azopyrazolone masking coupler and (3) a low impact development inhibitor releasing (LIDIR) coupler having at least one hydrogen atom at the coupling site and which does not substantially reduce contrast in the layer in which it is coated.

This invention also provides a photographic process and element which exhibits improved raw stock keeping without introducing any undue degradation in other photographic properties.

DETAILED DESCRIPTION OF THE INVENTION

The bicyclic azole compound of the invention contains at least two rings. Typically, the compound is a pyrazole or imidazole compound and may be represented by one of the formulas:

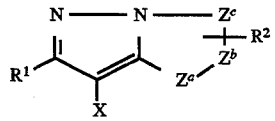

IA or

-continued

IB

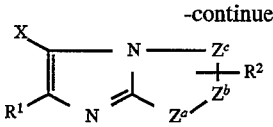

where the variables are as defined below.

An embodiment of the invention is a photographic element comprising a support bearing at least one photographic silver halide emulsion layer containing a dye-forming bicyclic azole coupler wherein the dye-forming coupler is represented by one of the formulas:

IIA

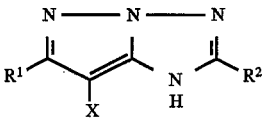

IIB

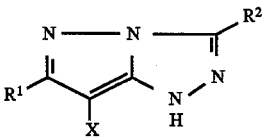

IIC

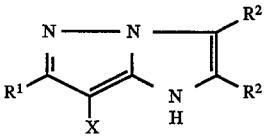

IID

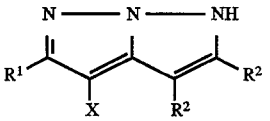

IIE

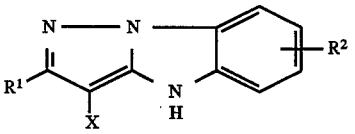

IIF

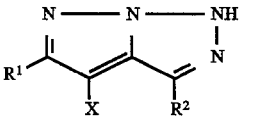

IIG

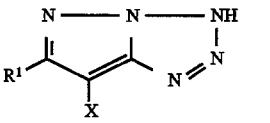

IIH

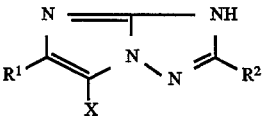

wherein $R^1$ and each $R^2$ are independently hydrogen or substituents that do not adversely affect the coupling action of the coupler; X is hydrogen or a coupling-off group known in the photographic art; and $Z^a$, $Z^b$ and $Z^c$ are independently selected from the group consisting of a substituted or unsubstituted methine group, =N—, =C— or —NH—, provided that one of either the $Z^a$—$Z^b$ bond or the $Z^b$—$Z^c$ bond is a double bond and the other is a single bond, and when the $Z^b$—$Z^c$ bond is a carbon-carbon double bond, it may form part of an aromatic ring.

As used herein, the term substituent, both for $R^1$ and $R^2$ and elsewhere unless otherwise specifically stated, has a broad definition. The substituent may be, for example, halogen, such as chlorine, bromine or fluorine; nitro; hydroxyl; cyano; and —$CO_2H$ and its salts; and groups which may be further substituted, such as alkyl, including straight or branched chain alkyl, such as methyl, trifluoromethyl, ethyl, t-butyl, 3-(2,4-di-t-amylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecyl-pyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N, N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido; and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfarnoylamino, and hexadecylsulfonamido; sulfamoyl, such as N-methylsulfamoyl, N-ethylsulfamoyl, N,N-dipropylsulfamoyl, N-hexadecylsulfamoyl, N, N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; ; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 42 carbon atoms and typically less than 30 carbon atoms, but greater numbers are possible depending on the particular substituents selected. Moreover, as indicated, the substituents may themselves be suitably substituted with any of the above groups.

The bicyclic azole coupler contains in the coupling position, represented by X, either hydrogen or a coupling-off group.

Coupling-off groups are known to those skilled in the art. Such groups can determine the equivalency of the coupler, can modify the reactivity of the coupler, or can advantageously affect the layer in which the coupler is coated or other layers in the element by performing, after release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclylimido, thiocyano, alkylthio, arylthio, heterocyclylthio, sulfonamido, phosphonyloxy and arylazo. They are described in, for example, U.S. Pat. Nos. 2,355,169; 3,227,551; 3,432,521; 3,476,563; 3,617,291; 3,880,661; 4,052,212 and 4,134,766; and in U.K. patents and published application numbers 1,466,728; 1,531,927; 1,533,039; 2,006,755A 2,017,704A; and in EP 285,274.

Examples of specific coupling-off groups are Cl, F, Br, —SCN, —$OCH_3$, —$OC_6H_5$, —$OCH_2C(=O)NHCH_2CH_2OH$, —$OCH_2C(=O)NHCH_2CH_2OCH_3$, —$OCH_2C(=O)NHCH_2CH_2OC(=O)OCH_3$, —$NHSO_2CH_3$, —$OC(=O)C_6H_5$, —$NHC(=O)C_6H_5$, $OSO_2CH_3$, —$P(=O)(OC_2H_5)_2$, —$S(CH_2)_2CO_2H$,

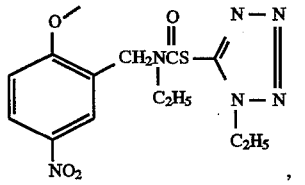

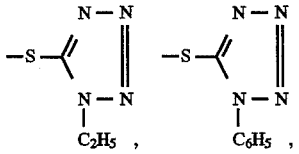

-continued

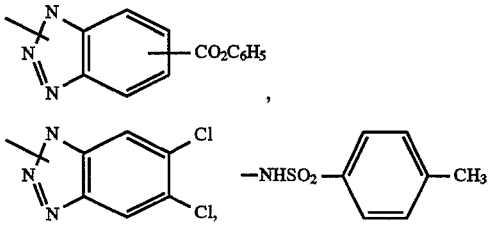

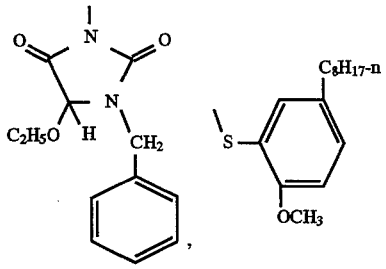

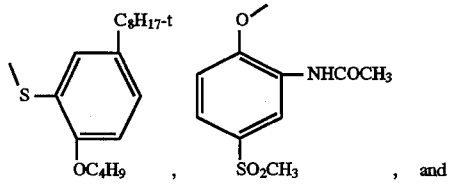

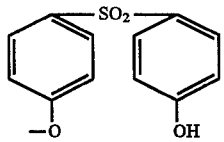

Suitably, the coupling-off group is H or halogen, and more specifically, H or Cl. Suitably, $R^1$ and $R^2$ together contain from 8 to 50 carbon atoms or more and typically 12 to 42 carbon atoms.

Generally, either $R^1$ or $R^2$ contains a ballast group where the ballast group is an organic radical of such size and configuration as to confer on the coupler molecule sufficient bulk to render the coupler substantially non-diffusible from the layer in which it is coated in a photographic element. Thus, the combination of groups $R^1$ and $R^2$ from the formula are chosen to meet this criteria as can be determined by one skilled in the art.

Typical pyrazolo-[3,2-c]-1,2,4-triazole magenta image dye-forming couplers within the described structure are disclosed in, for example, U.S. Pat. Nos. 4,443,536; 4,777,121; 4,808,502; 4,835,094; 4,960,685; and 5,019,489; and European Patents 284,240 and 285,274. U.S. Patent U.S. Patent European Patent; and U.S. Patent.

Typical pyrazolo-[1,5-b]-1,2,4-triazole couplers are described in, for example, U.S. Pat. Nos. 4,540,654; 4,659,652; 4,774,172; 4,822,730; and 4,925,781; Japanese Published Patent Application No. 61-147254; and European Patents 119,860; 226,849; 234,428; and 294,785.

Typical bicyclic imidazole compounds are exemplified in PCT patent publication WO 92/12464.

Specific examples of couplers useful in the element of the invention are

M-1
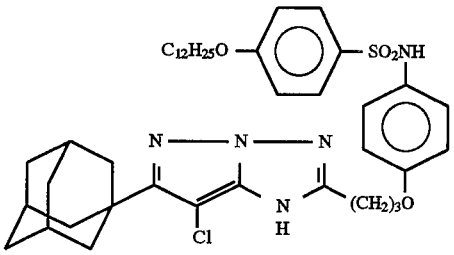
M-2
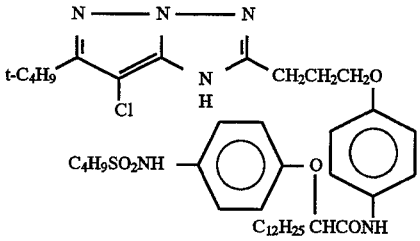
M-3
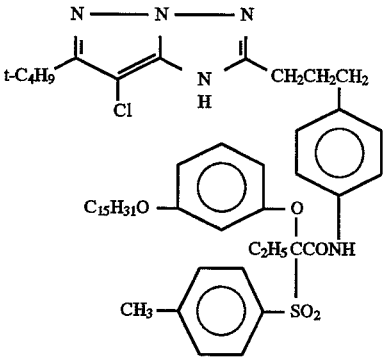
M-4
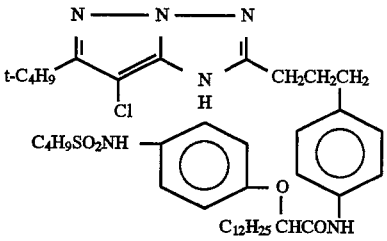
M-5
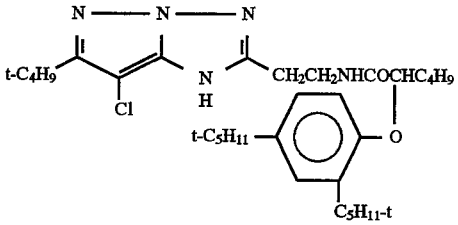
M-6
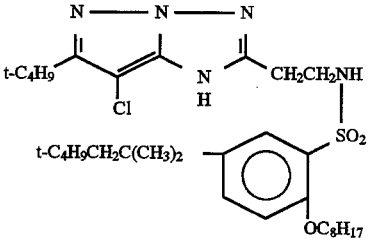

-continued
M-7
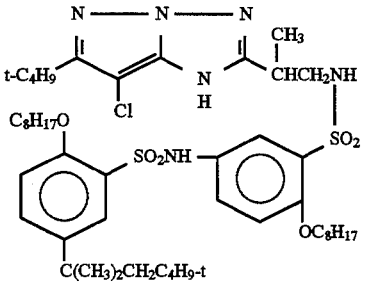
M-8
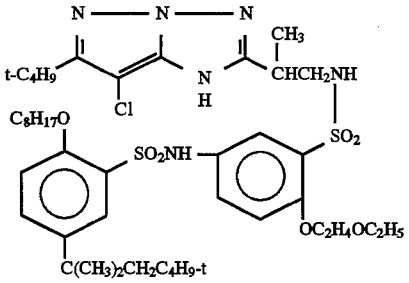
M-9
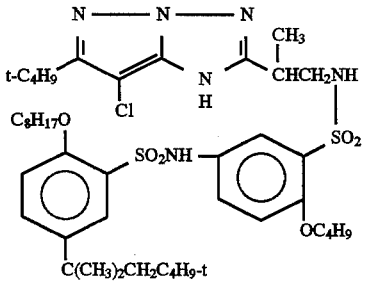
M-10
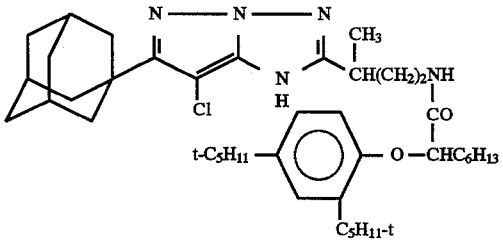
M-11
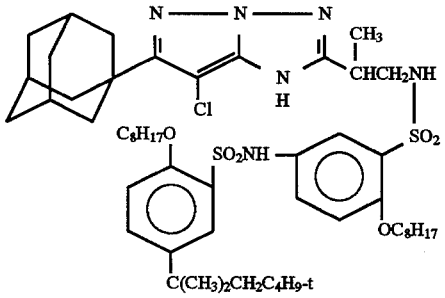

-continued
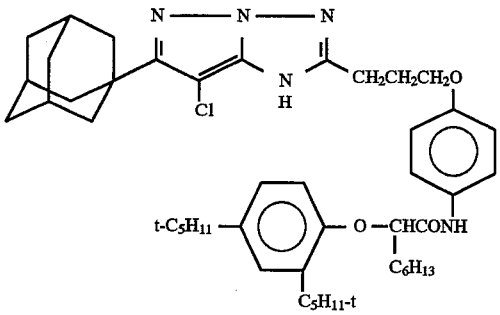
M-12
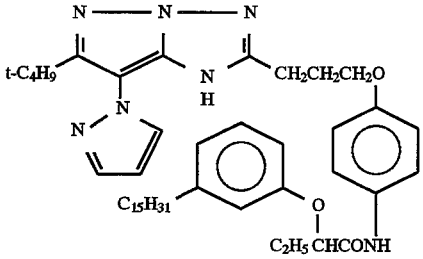
M-13
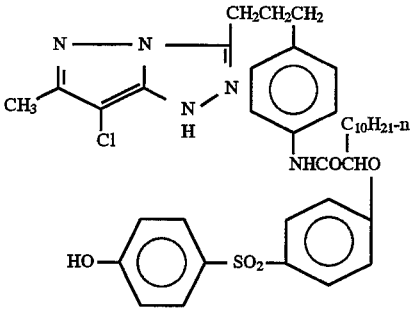
M-14
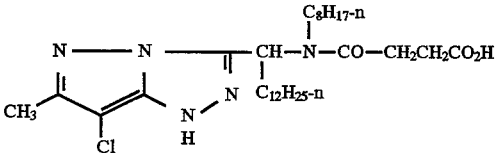
M-15
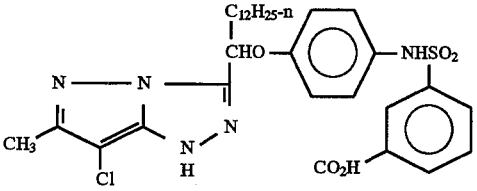
M-16
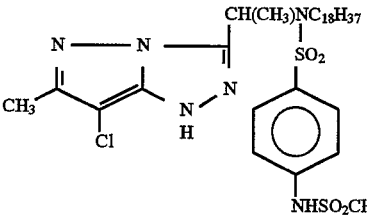
M-17

-continued
M-18
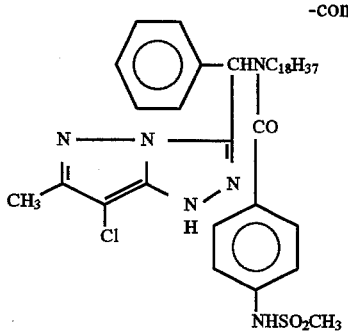
M-19
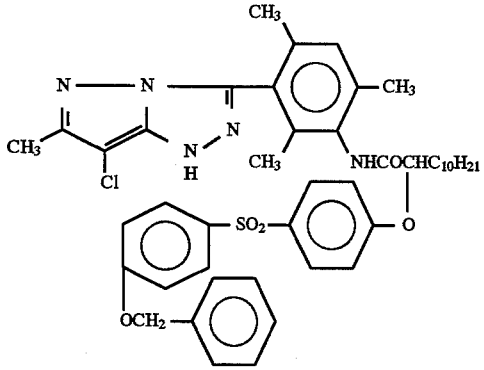
M-20
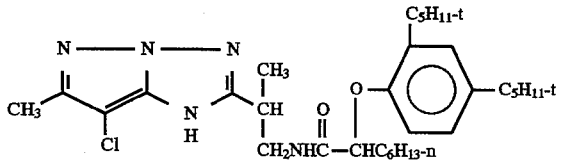
M-21
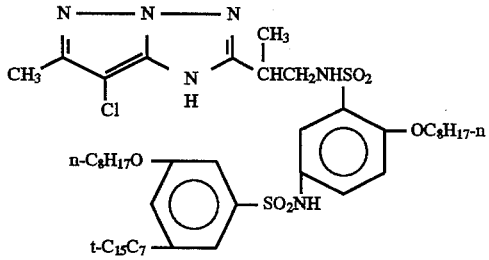
M-22
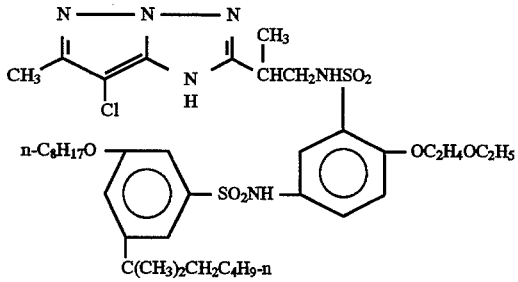
M-23
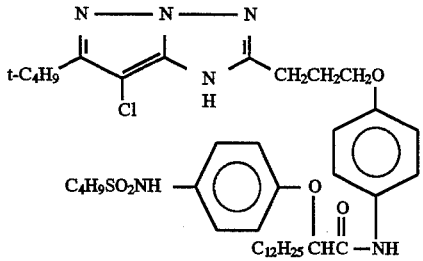

-continued
M-24
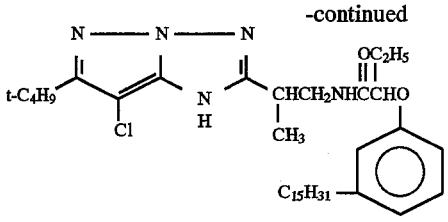
M-25
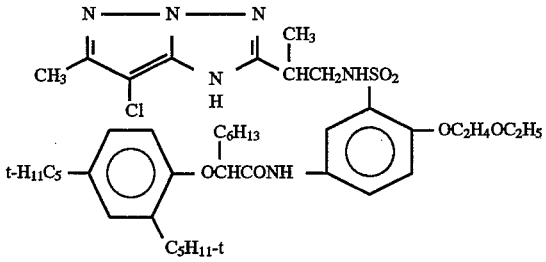
M-26
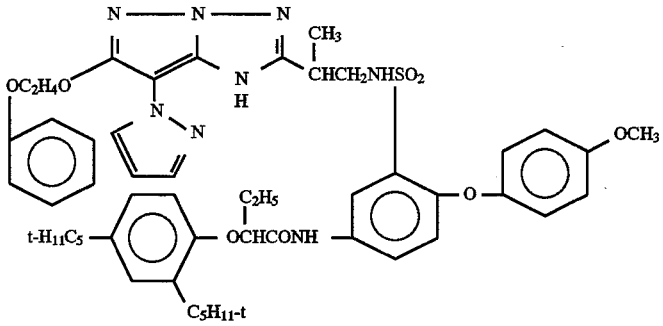
M-27
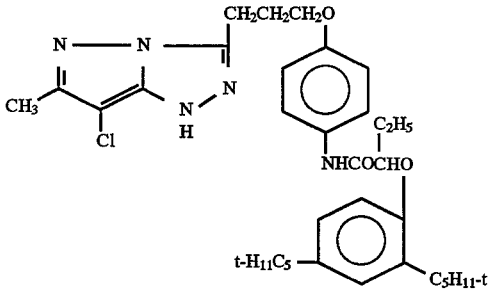
M-28
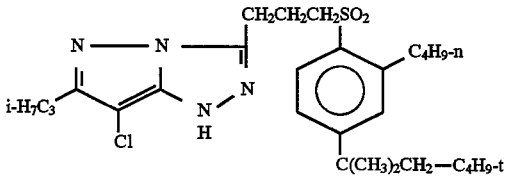
M-29
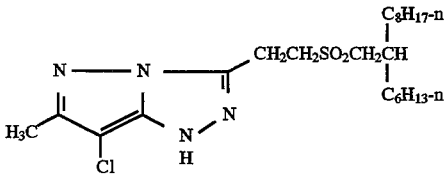
M-30
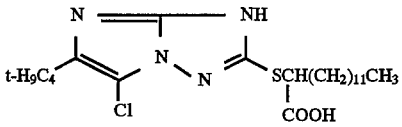

The arylazopyrazolone colored coupler of the invention can be any such compound which provides a magenta color in response to green exposure upon development. The general structure of such materials is shown in the following formula:

$$Cp—N=N—R_3$$

In the formula, Cp represents a 5-pyrazolone magenta coupler residual group (provided, however, that the azo group is attached to the active site of the magenta coupler at the 4-position), and $R_3$ represents an aryl group (including the group having a substituent).

The magenta coupler residual group represented by Cp suitably has the formula:

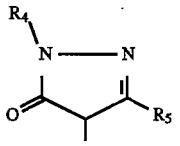

In the formula, $R_4$ represents a substituted or unsubstituted aryl group; $R_5$ represents a substituted or unsubstituted acylamino group, anilino group, ureido group or carbamoyl group. $R^4$ and $R^5$ typically contain 1 to 42 carbon atoms.

The aryl group represented by $R_4$ is typically a phenyl group. The substituents for the aryl group represented by $R_4$ may include, for example, a halogen atom (for example, fluorine, chlorine, bromine, etc.), an alkyl group (for example, methyl, ethyl, etc.), an alkoxy group (for example, methoxy, ethoxy, etc.), an aryloxy group (for example, phenyloxy, naphthayloxy, etc.), an acylamino group (for example, benzamide, α-(2,4-di-t-amylphenoxy)-butylamide, etc.), a sulfonylamino group (for example, benzenesulfonamide, n-hexadecansulfonamide, etc.), a sulfamoyl group (for example, methylsulfamoyl, phenylsulfamoyl, etc.), a carbamoyl group (for example, an n-butylcarbamoyl group, a phenyl carbamoyl group, etc.), a sulfonyl group (for example, methylsulfonyl, n-dodecylsulfonyl, benzenesulfonyl, etc.), an acyloxy group, an ester group, a carboxyl group, a sulfo group, a cyano group, a nitro group, a trifluoro group, etc.

Specific examples of $R_4$ are phenyl, 2,4,6-trichlorophenyl, pentachlorophenyl, pentafluorophenyl, 2,4-6-trimethylphenyl, 2-chloro-4,6-dimethylphenyl, 2,6-dichloro-4-methylphenyl, 2,4-dichloro-6-methylphenyl, 2,4-dichloro-6-methoxylphenyl, 2,6-dichloro-4-methoxyphenyl, 2,6-dichloro-4-[α-(2,4-di-t-amylphenoxy) acetamide]phenyl, 2,6-dichloro-4-dodecysulfonyl, 2,6-dichloro-4-(N-dodecyl) sulfamoyl, 2,4-dichloro 6-trifluoro methyl, etc.

The acylamino group represented by $R_5$ may include, for example, pivaloylamino, n-tetradecanamide, α-(3-pentadecylphenoxy)butylamide, 3-[α(2,4-di-t-amylphenoxy)acetamido]benzamide, benzamide, 3-acetoamidobenzamide, 3-(3-n-dodecylsuccinimide) benzamide, 3-(4-n-dodecyloxybenzenesulfonamide) benzamide, etc.

The anilino group represented by $R_5$ may include, for example, anilino, 2-chloroanilino, 2,4-dichloroanilino, 2,4-dichloro-5-methoxyanilino, 4-cyanoanilino, 2-chloro-5-[α-(2,4-di-t-amylphenoxy)butylamido]anilino, 2-chloro-5-(3-octadecenylsuccinimide)anilino, 2-chloro-5-n-tetradecanamidoanilino, 2-chloro-5-[α(3-t-butyl-4-hydroxyphenoxy)tetradecanamido]analino, 2-chloro-5-n-hexadecansulfoamidoanilino, etc.

The ureido group represented by $R_5$ may include, for example, methylureido, phenylureido, 3-[α-(2,4-di-t-amylphenoxy)butylamido]phenylureido, etc.

The carbamoyl group represented by $R_5$ may include, for example, n-tetradecylcarbamoyl, phenylcarbamoyl, 3-[α-(2,4-di-t-amylphenoxy) acetamide]carbamoyl, etc.

The aryl group represented by $R_3$ is preferably a phenyl group or a naphthyl group.

Substituents for the aryl group $R_3$ may include, for example, a halogen atom, an alkyl group, an alkoxy group, an aryloxy group, a hydroxyl group, an acyloxy group, a carboxyl group, an alkoxycarbonyl group, an aryloxycarbonyl group, an alkylthio group, an arylthio group, an alkylsulfonyl group, an arylsulfonyl group, an acyl group, a sulfonamide group, a carbamoyl group, a sulfamoyl group, etc. There may be any combination of these substituents and may be up to 5 substituents on a phenyl ring and 9 for a napthyl group.

Particularly suitable substituents include an alkyl group, a hydroxyl group, an alkoxy group and acylamino group.

Examples of the colored magenta couplers represented by the formula are shown below, but are by no means limited to these.

CM-1

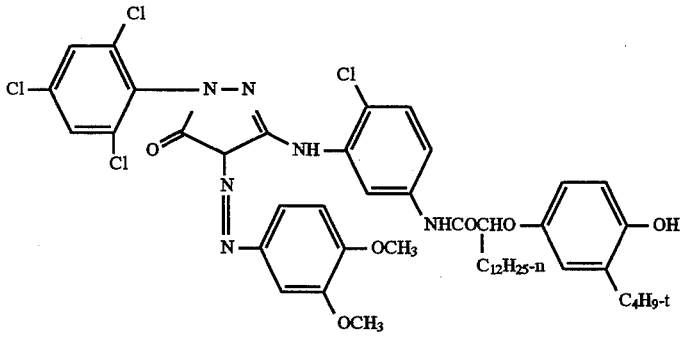

-continued
CM-2
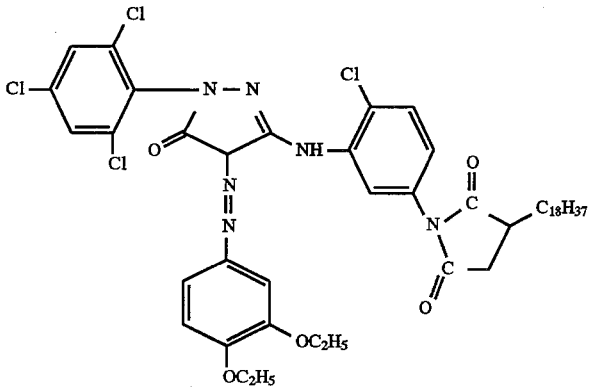
CM-3
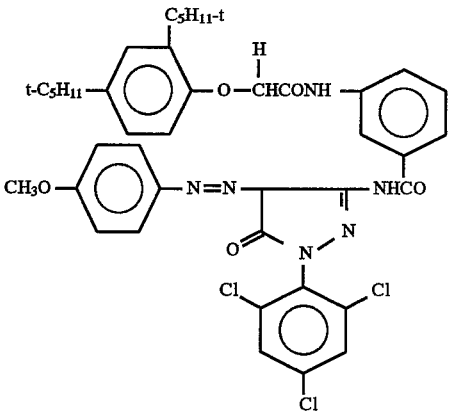
CM-4
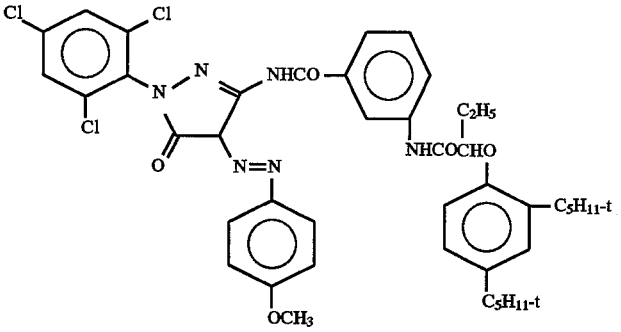
CM-5
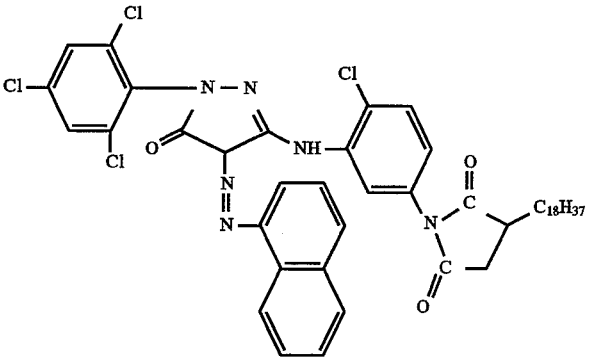

-continued
CM-6
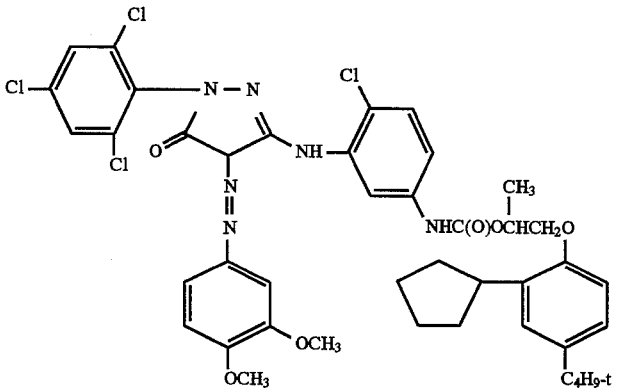
CM-7
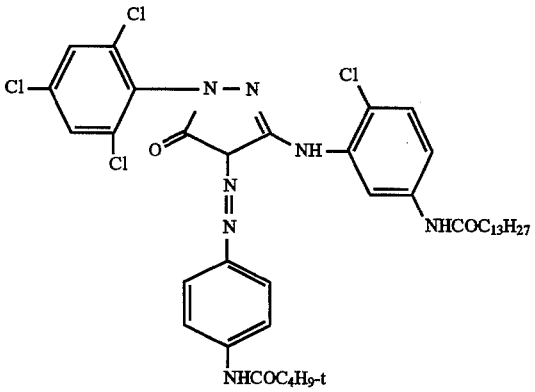
CM-8
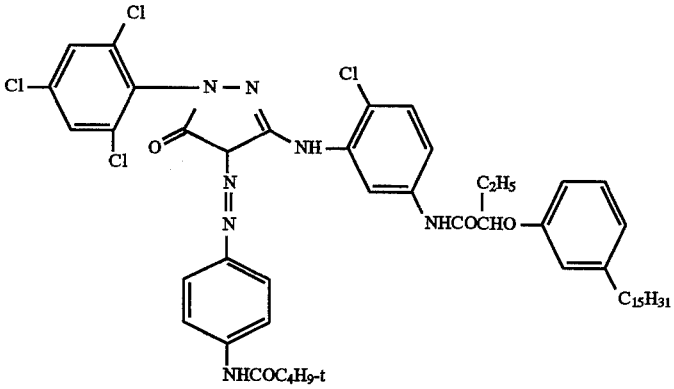
CM-9
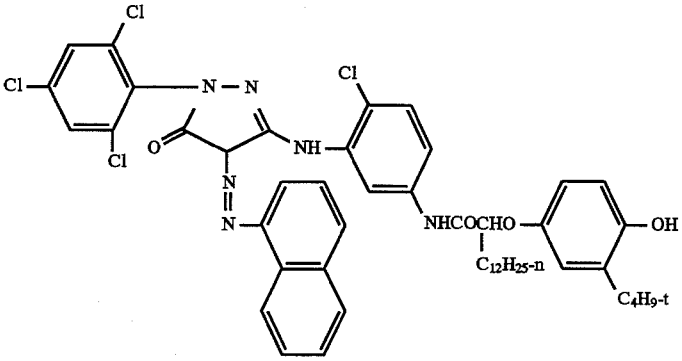

-continued
CM-10
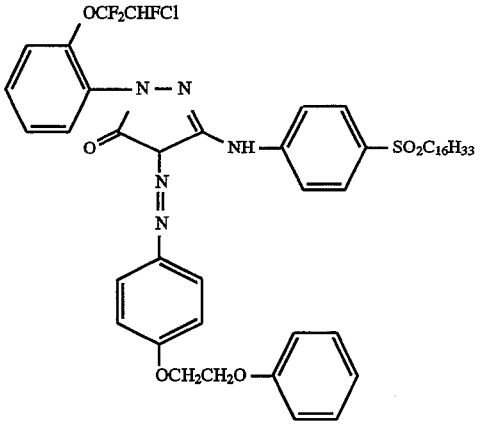
CM-11
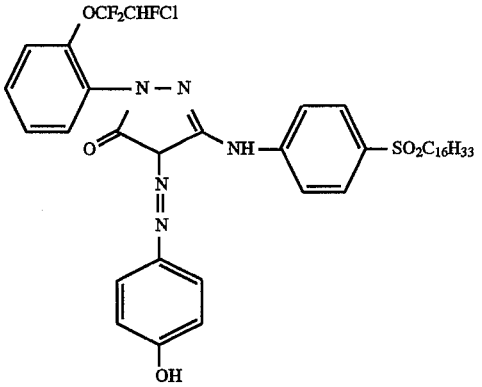
CM-12
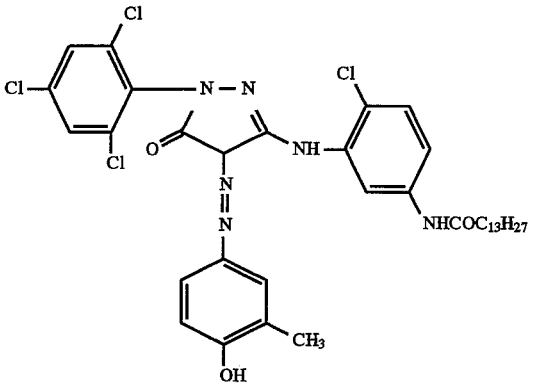
CM-13
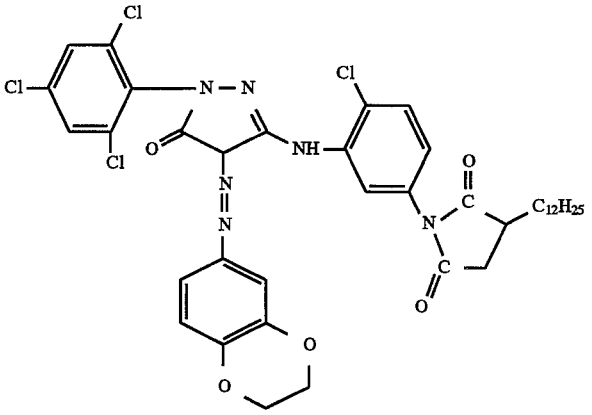

-continued
CM-14
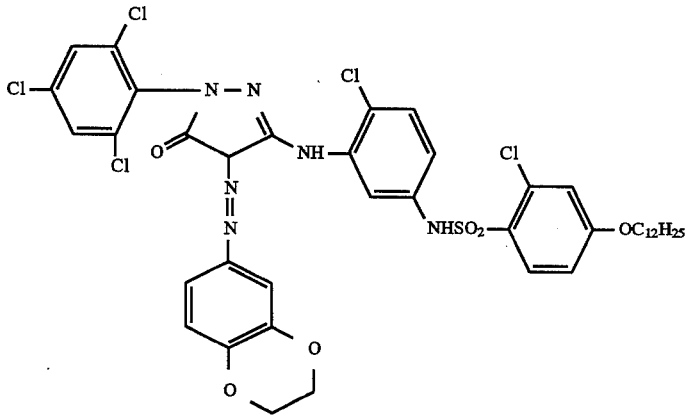
CM-15
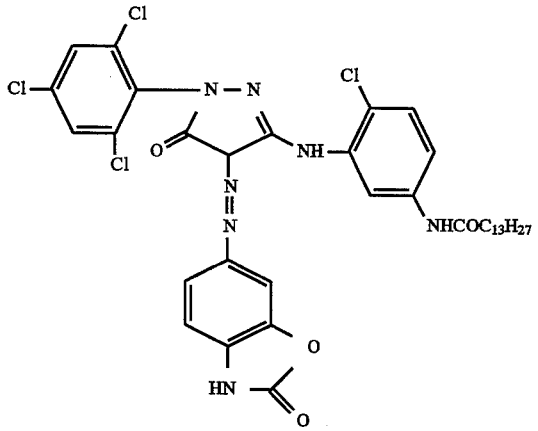
CM-16
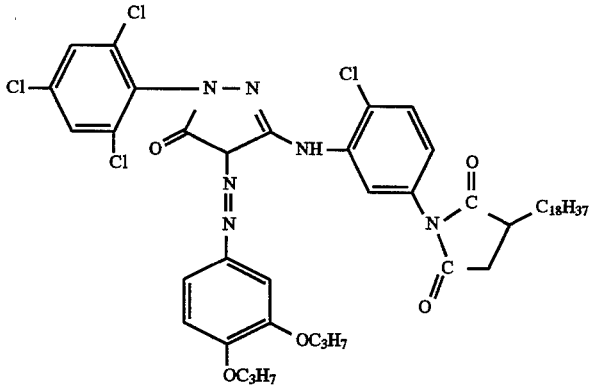
CM-17
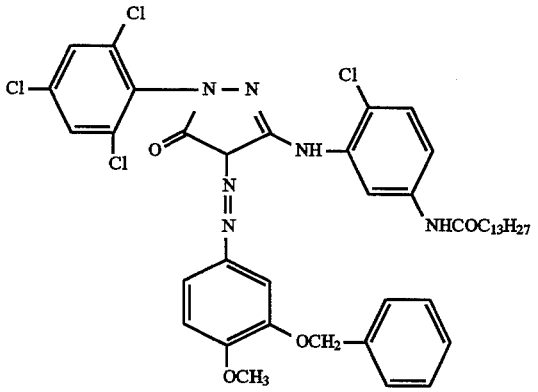

-continued
CM-18
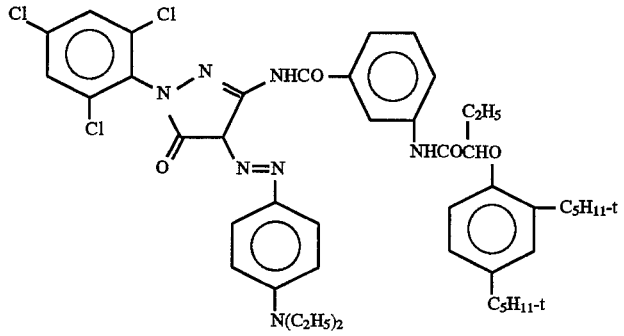
CM-19
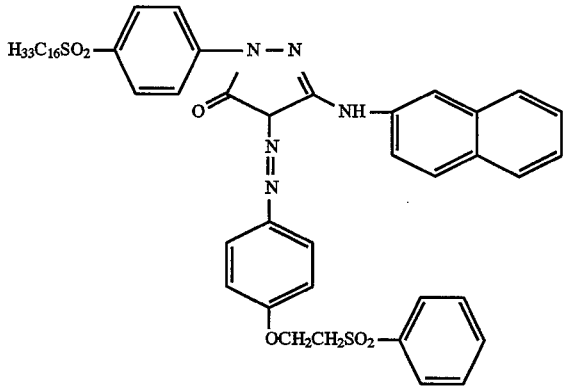
CM-20
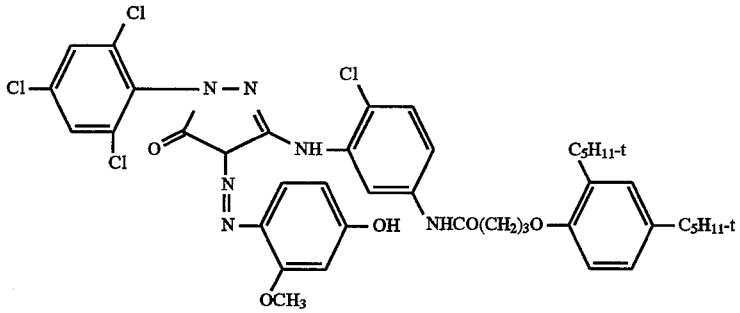
CM-21
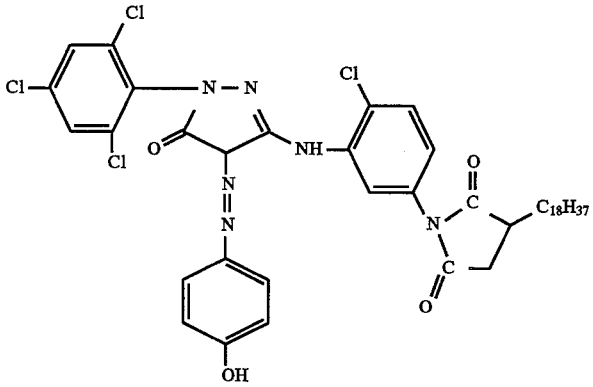

-continued
CM-22
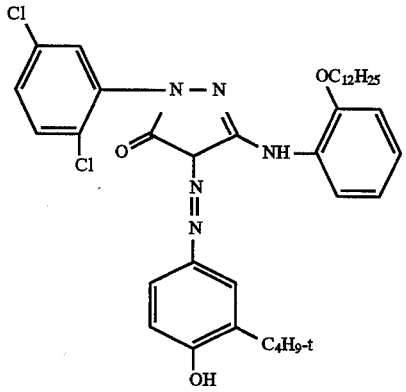
CM-23
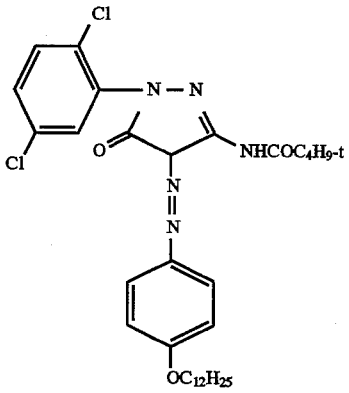
CM-24
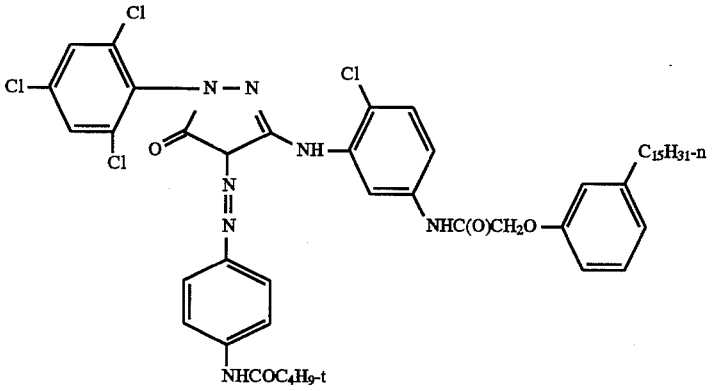
CM-25
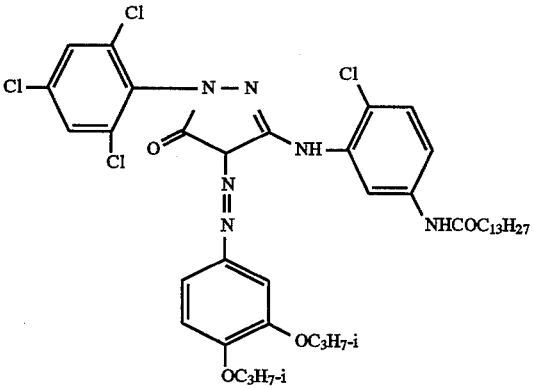

-continued
CM-26
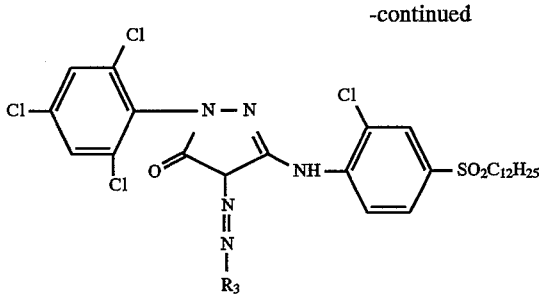
CM-27
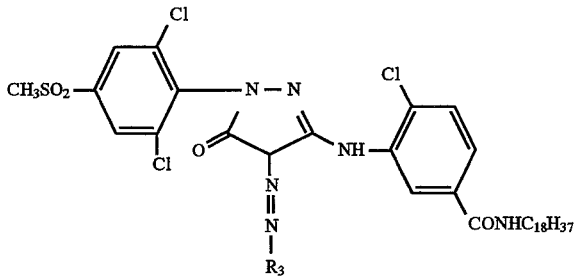
CM-28
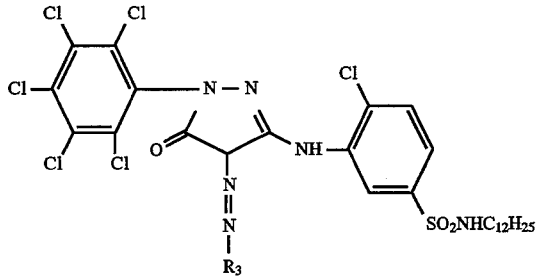
CM-29
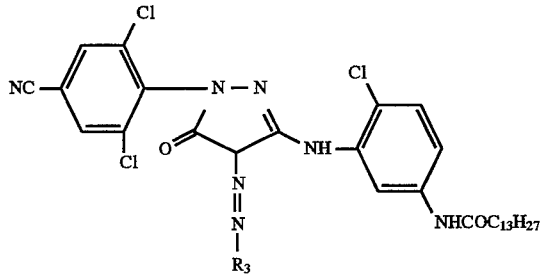
CM-30
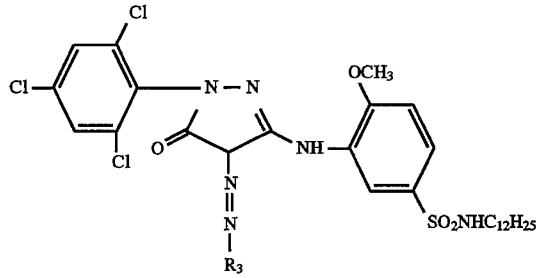
CM-31
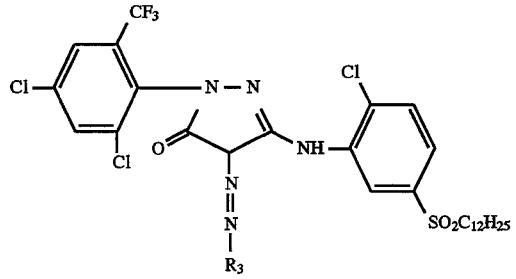

In the last six formulas, $R_3$ can be any one of the following, for example:

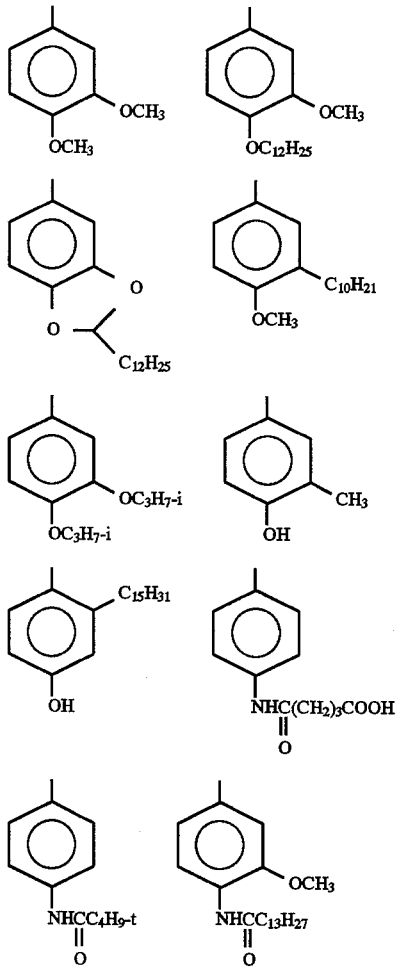

Synthesis of the masking couplers of the invention is well-known and may be generally carried out as more fully described in U.S. Pat. Nos. 2,763,552; 2,801,171; 2,852,370; 3,005,712; 3,519,429; 4,277,559; and Japanese Published Applications 49/123,625; 49/131,448; 52/42121; 52/102,723; 54/52,532; 58/1726; 59/214,853; 61/189,538; 62/50,830; 62/133,458; and 63/104,523.

Examples of substituent groups for the colored masking couplers or bicyclic azole couplers above include: an alkyl group which may be straight or branched, and which may be substituted, such as methyl, ethyl, n-propyl, n-butyl, t-butyl, trifluoromethyl, tridecyl or 3-(2,4-di-t-amylphenoxy) propyl; an alkoxy group which may be substituted, such as methoxy or ethoxy; an alkylthio group which may be substituted, such as methylthio or octylthio; an aryl group, an aryloxy group or an arylthio group, each of which may be substituted, such as phenyl, 4-t-butylphenyl, 2,4,6-trimethylphenyl, phenoxy, 2-methylphenoxy, phenylthio or 2-butoxy-5-t-octylphenylthio; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; cyano; an acyloxy group which may be substituted, such as acetoxy or hexadecanoyloxy; a carbamoyloxy group which may be substituted, such as N-phenylcarbamoyloxy or N-ethylcarbamoyloxy; a silyloxy group which may be substituted, such as trimethylsilyloxy; a sulfonyloxy group which may be substituted, such as dodecylsulfonyloxy; an acylamino group which may be substituted, such as acetamido or benzamido; an anilino group which may be substituted, such as phenylanilino or 2-chloroanilino; an ureido group which may be substituted, such as phenylureido or methylureido; an imido group which may be substituted, such as N-succinimido or 3-benzylhydantoinyl; a sulfamoylamino group which may be substituted, such as N,N-dipropyl-sulfamoylamino or N-methyl-N-decylsulfamoylamino.

Additional examples of substituent groups include: a carbamoylamino group which may be substituted, such as N-butylcarbamoylamino or N,N-dimethyl-carbamoylamino; an alkoxycarbonylamino group which may be substituted, such as methoxycarbonylamino or tetradecyloxycarbonylamino; an aryloxycarbonylamino group which may be substituted, such as phenoxycaronylamino or 2,4-di-t-butylphenoxycarbonylamino; a sulfonamido group which may be substituted, such as methanesulfonamido or hexadecanesulfonamido; a carbamoyl group which may be substituted, such as N-ethylcarbamoyl or N,N-dibutylcarbamoyl; an acyl group which may be substituted, such as acetyl or (2,4-di-t-amylphenoxy)acetyl; a sulfamoyl group which may be substituted such as N-ethylsulfamoyl or N,N-dipropylsulfamoyl; a sulfonyl group which may be substituted, such as methanesulfonyl or octanesulfonyl; a sulfinyl group which may be substituted, such as octanesulfinyl or dodecylsulfinyl; an alkoxycarbonyl group which may be substituted, such as methoxycarbonyl or butyloxycarbonyl; an aryloxycarbonyl group which may be substituted, such as phenyloxycarbonyl or 3-pentadecyloxycarbonyl; an alkenyl group carbon atoms which may be substituted; a carboxyl group which may be substituted; a sulfo group which may be substituted; hydroxyl; an amino group which may be substituted; or a carbonamido group which may be substituted.

Substituents for the above substituted groups include halogen, an alkyl group, an aryl group, an aryloxy group, a heterocyclic or a heterocyclic oxy group, cyano, an alkoxy group, an acyloxy group, a carbamoyloxy group, a silyloxy group, a sulfonyloxy group, an acylamino group, an anilino group, a ureido group, an imido group, a sulfonylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, hydroxyl, an amino group or a carbonamido group.

Generally, the above groups and substituents thereof which contain an alkyl group may include an alkyl group having 1 to 30 carbon atoms. The above groups and substituents thereof which contain an aryl group may include an aryl group having 6 to 40 carbon atoms, and the above groups and substituents which contain an alkenyl group may include an alkenyl group having 2 to 6 carbon atoms.

Most preferred are chloride, and substituted or unsubstituted sulfamoyl, sulfone, carbamoyl, carboxylic acid, ester, trifluoromethyl, carbonamido, and cyano groups. If desired, these groups may contain a ballast and may be further substituted. One or more electron withdrawing groups may be present.

The third essential component of the invention is a "low impact" development inhibitor releasing (LIDIR) coupler.

Typically, a development inhibitor releasing coupler is comprised of a group capable of coupling with oxidized developer ("PARENT" or "COUP") which contains at least one hydrogen atom at the coupling site and a coupling-off group, which may or may not contain a linking and/or timing group, and which contains an inhibitor group ("INH".) Normally, when DIR couplers are added to photographic elements they reduce contrast in the layer in which they are coated, and they serve to improve acutance by means of chemical adjacency effects. The term "low impact" is meant to encompass those compounds which have the COUP and INH groups typical of DIR couplers but which do not substantially reduce contrast in the layer in which they are coated in accordance with the test described hereinafter.

Low granularity is one of the key photographic objectives. One method used to reduce granularity is to employ coupler starvation. Under circumstances of coupler starvation, more silver is present in a layer than there is coupler to react with all of the oxidized developer that is generated. This causes local depletion of coupler in the immediate area of the developing silver grain and allows oxidized developer to diffuse away from the silver grain some distance before coming into contact with dye-forming coupler. This creates a more diffuse dye cloud and consequently serves to lower granularity. Because this method limits the density and exposure range (latitude) of the layer, it is most commonly used in multilayer film systems where two or more layers of the same sensitivity are used to create a particular color record. In particular, the granularity contribution of the most light-sensitive layer is often reduced through coupler starvation because it contains the largest silver grains.

The largest reductions in granularity due to coupler starvation occur in systems in which there is both a high rate of silver development and high coupler activity. The addition of typical DIRs to a layer slows down development and prevents or decreases the degree of coupler starvation and correspondingly limits granularity improvements. LIDIR couplers allow better coupler starvation because they do not substantially affect silver development. Simultaneously, they improve the raw stock keeping of photographic elements containing combinations of bicyclic azole image couplers together with azopyrazolone masking couplers.

Any DIR coupler which otherwise meets the typical requirements of a DIR, but which does not, because of its inability to interfere with silver development, substantially reduce contrast in the layer in which it is included, qualifies as a "low impact" DIR (LIDIR.) Suitably, when the DIR compound is employed in a weight ratio to image coupler of 1/10 and there is a reduction in the fresh gamma under the test conditions of Experiment 1 herein of less than 25%, then the DIR qualifies as a LIDIR. Typically, in actual practice, the weight ratio of LIDIR to image coupler in the same or associated layer ranges from 1 to 1000 to 500 to 3. DIR coupler levels of from 1 to 500 mg/ and image coupler levels of from 3 to 1000 mg/ are common.

There are two general classes of DIR couplers which qualify as LIDIR couplers. Both classes of couplers have at least one hydrogen at the coupling site in order to permit the coupler to interreact with the diazonium species believed responsible for the degradation of the image coupler. "Class 1" LIDIR couplers comprise couplers that contain a COUP and an INH group as in a typical DIR, but are not effective to reduce contrast because these LIDIR couplers do not substantially react with oxidized developer. Therefore, the inhibitor (INH), whether strong or weak, is not substantially released during processing. "Class 2" LIDIR couplers may be capable of reacting with oxidized developer but contain an INH group whose properties are such that it does not retard silver development to a substantial extent. It is a weak inhibitor even though released. Any COUP is suitable for use with such an INH group. It is possible that a particular low impact DIR coupler has a COUP and an INH group which place it in both Class 1 and Class 2.

A "Class 1" DIR is thus a DIR material that contains an inhibitor but which does not substantially react with oxidized developer. The formula for such a material is represented by:

COUP-INH where COUP and INH are like the DIR couplers known in the art but whose properties have been adjusted so that the coupler cannot substantially react with oxidized developer (Dox). In general, poor reactivity towards Dox can be accomplished in two ways: steric hindrance of the coupling site and delocalization of the anion to such a degree that it becomes a poor nucleophile.

The reactivity of a Class 1 DIR coupler of low nucleophilicity can be further determined with reference to the ease with which the DIR coupler is ionized at the coupling-off position. The pK of the coupler compound may be determined in accordance with the method described in Albert and Serjeant, *Ionization Constants of Acids and Bases*, John Wiley and Sons, New York. The pK is the negative logarithm of the ionization constant of the compound. It also corresponds to the pH value at which the DIR coupler is 50% ionized. If the pK of the coupler is 8 or less, or more suitably 7 or less then the DIR coupler qualifies as a "Class 1" low impact DIR coupler because it will not substantially react with oxidized developer.

"COUP" groups useful in the invention (Class 2 or Class 1 if pK is 8 or less) are as follows:

Couplers which form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,451,820; 3,519,429; 3,615,502; 3,824,250; 4,076,533; 4,080,211; 4,215,195; 4,518,687; and 4,612,278; European Published Applications 177,765; 240,852; 284,239; 284,240; "Farbkuppler-eine Literaturubersicht," published in Agfa Mitteilungen, Band III, pp. 126–156 (1961), and Section VII D of *Research Disclosure*, Item 308119, December 1989. Preferably such couplers are pyrazolones or pyrazolotriazoles.

Couplers which form yellow dyes upon reaction with oxidized and color developing agent are described in such representative patents and publications as: U.S. Pat. Nos. 2,298,443; 2,407,210; 2,875,057; 3,048,194; 3,265,506; 3,447,928; 4,022,620; 4,443,536; "Farbkuppler-eine Literaturubersicht," published in Agfa Mitteilungen, Band III, pp. 112–126 (1961), and Section VII D of *Research Disclosure*, Item 308119, December 1989. Preferably such couplers are acylacetamides, such as benzoylacetamides and pivaloylacetamides.

Couplers which form colorless products upon reaction with oxidized color developing agent are described in such representative patents as: U.K. Patent No. 861,138; U.S. Pat. Nos. 3,632,345; 3,928,041; 3,958,993 and 3,961,959. Preferably, such couplers are cyclic carbonyl-containing compounds which react with oxidized color developing agents but do not form dyes.

Representative examples of parent groups or COUPs useful in the present invention are as follows:

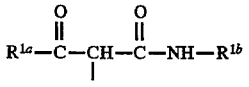

1A

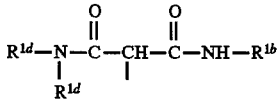

1B

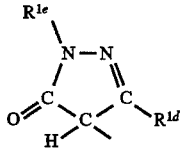

1C

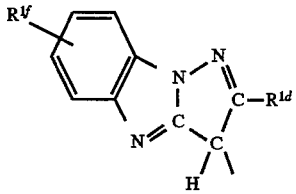

1D

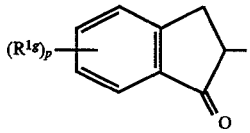

1E

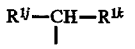

1F

A free bond from the coupling site in the above formulas indicates a position to which the coupling release group or coupling-off group is linked. In the above formulae, when $R^{1a}$, $R^{1b}$, $R^{1c}$, $R^{1d}$, $R^{1e}$, $R^{1f}$, $R^{1g}$, $R^{1j}$, or $R^{1k}$ contains a ballast or antidiffusing group, it is typically selected so that the total number of carbon atoms is from 8 to 42 and generally from 10 to 30.

$R^{1a}$ represents an aliphatic- or alicyclic-hydrocarbon group, an aryl group, an alkoxyl group, or a heterocyclic group, and $R^{1b}$ and $R^{1c}$ each represents an aryl group or a heterocyclic group.

The aliphatic- or alicyclic hydrocarbon group represented by $R^{1a}$ preferably has at most 22 carbon atoms, may be substituted or unsubstituted, and aliphatic hydrocarbon may be straight or branched. Preferred examples of the substituent for these groups represented by $R^{1a}$ are an alkory group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tert-butyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido) isopropyl group, an α-(phthalimido)isopropyl group, an α-(benzenesulfonamido)isopropyl group, and the like.

When $R^{1a}$, $R^{1b}$, or $R^{1c}$ is an aryl group (especially a phenyl group), the aryl group may be substituted. The aryl group (e.g., a phenyl group) may be substituted with groups having typically not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R^{1a}$, $R^{1b}$, or $R^{1c}$ may be substituted with an amino group which may be further substituted with a lower alkyl group having from 1 to 6 carbon atoms, a hydroxyl group, —COOM and —$SO_2M$ (M=H, an alkali metal atom, $NH_4$), a nitro group, a cyano group, a thiocyano group, or a halogen atom.

$R^{1a}$, $R^{1b}$, or $R^{1c}$ may represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for the phenyl group represented by $R^{1a}$, $R^{1b}$ or $R^{1c}$.

When $R^{1a}$ represents an alkoxy group, the alkyl moiety of the alkoxyl group can be a straight or branched alkyl group, an alkenyl group, a cycloalkyl group, or a cycloalkenyl group each having typically at most 32 carbon atoms, generally at most 22 carbon atoms. These substituents may be substituted with groups such as halogen atom, an aryl group and an alkoxyl group to form a group having at most 32 carbon atoms.

When $R^{1a}$, $R^{1b}$, or $R^{1c}$ represents a heterocyclic ring, the heterocyclic group is linked to a carbon atom of the carbonyl group of the acyl group in α-acylacetamido or to a nitrogen atom of the amido group through one of the carbon atoms constituting the ring. Examples of such heterocyclic rings are thiophene, furan, pyran, pyrrole, pyrazole, pyridine, pyrazine, pyrimidine, pyridazine, indolizine, imidazole, thiazole, oxazole, triazine, thiadiazine and oxazine. These groups may further have a substituent or substituents in the ring thereof. Examples of the substituents include those defined for the aryl group represented by $R^{1a}$, $R^{1b}$ and $R^{1c}$.

In formula 1C, $R^{1e}$ is a group typically having at most 32 carbon atoms, generally at most 22 carbon atoms, and it is a straight or branched alkyl group (e.g., a methyl group, an isopropyl group, a tert-butyl group, a hexyl group and a dodecyl group), an alkenyl group (e.g., an allyl group), a cycloalkyl group (e.g., a cyclopentyl group, a cyclohexyl group and a norbornyl group), an aralkyl group (e.g., a benzyl group and a β-phenylethyl group), or a cycloalkenyl group (e.g., a cyclopentenyl group and a cyoloalkenyl group). These groups may be further substituted with groups such as a halogen atom, a nitro group, a cyano group, an aryl group, an alkoxyl group, an aryloxy group, —COOM (M=H, an alkali metal atom, $NH_4$) an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamide group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group, and a mercapto group.

Furthermore $R^{1e}$ may represent an aryl group (e.g., a phenyl group and an α- or β-naphthyl group). This aryl group may be substituted with at least one group. Examples of such substituents are an alkyl group, an alkenyl group, a cycloalkyl group, an aralkyl group, a cycloalkenyl group, a halogen atom, a nitro group, a cyano group, an aryl group, an alkoxyl group, an aryloxy group, —COOM (M=H, an alkali metal atom, $NH_4$), an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, alkylsulfonyl group, an arylthio group, an alkylthio group, an alkylamino group, a dialkylamino group, an anilino group, an N-alkylanilino group, an N-arylanilino group, an N-acylanilino group, a hydroxyl group, and a mercapto group. More preferred as $R^{1e}$ is a phenyl group which is substituted with at least one of the groups such as an alkyl group, an alkoxyl group, and a halogen atom in at least one ortho-position, because it decreases color formation due to light or heat of the coupler remaining in a film member.

Furthermore, $R^{1e}$ may represent a heterocyclic group (e.g., 5- or 6-membered heterocyclic rings and condensed heterocyclic groups containing at least one hetero atom i.e., a nitrogen atom, an oxygen atom or a sulfur atom such as a pyridyl group, a quinolyl group, a furyl group, a benzothiazolyl group, an oxazolyl group, an imidazolyl group, and a naphthooxazolyl group), a heterocyclic group substituted with a group as listed for the above aryl group represented by $R^{1e}$, an aliphatic, alicyclic or aromatic acyl group, an alkylsulfonyl group, an arysulfonyl group, an alkylcarbarmoyl group, an arylcarbamoyl group, an alkylthiocarbanoyl group or an arylthiocarbamoyl group.

$R^{1d}$ represents a hydrogen atom, and represents groups having typically at most 32 carbon atoms, generally at most 22 carbon atoms, such as a straight or branched alkyl group, an alkenyl group, a cycloalkyl group, an aralkyl group, a cycloalkenyl group (these groups may have a substituent or substituents as listed for $R^{1e}$), an aryl group, a heterocyclic group (these groups may have a substituent or substituents as listed for $R^{1e}$ an alkoxycarbonyl group (e.g., a methoxycarbonyl group, an ethoxycarbonyl group, and a stearyloxycarbonyl group), an aryloxycarbonyl group (e.g., a phenoxycarbonyl group and a naphthoxycarbonyl group), an aralkyloxycarbonyl group (e.g., a benzyloxycarbonyl group), an alkoxy group (e.g., a methoxy group, an ethoxy group, and a heptadecyloxy group), an aryloxy group (e.g., a phenoxy group and a tolyloxy group), an alkylthio group (e.g., an ethylthio group and a dodecylthio group), an arylthio group (e.g., a phenylthio group and an α-naphthylthio group), —COOM (M=H alkali metal atom $NH_4$), an acylamino group e.g., an acetylamino group and a 3-[(2,4-di-tert-amylphenoxy)acetamido]benzamido group), a diacylamino group, an N-alkylacylamino group (e.g., an N-methylpropionamido group), an N-arylacylamino group (e.g., an N-phenylacetamido group), a ureido group, a substituted ureido group (e.g., an N-arylureido group, and an N-alkylureido group), a urethane group, a thiourethane group, an arylamino group (e.g., a phenylamino group, an N-methylanilino group, a di-phenylamino group, an N-acetylanilino group, and a 2-chloro-5-tetradecaneamidoanilino group), an alkylamino group (e.g., an n-butylamino group, a methylamino group and a cyclohexylamino group), a cycloamino group (e.g., a piperidino group, and a pyrrolidino group), a heterocyclic amino group (e.g., a 4-pyridylamino group and a 2-benzooxazolidyl amino group), an alkylcarbonyl group (e.g., a methylcarbonyl group), an arylcarbonyl group (e.g., a phenylcarbonyl group), a sulfonamido group (e.g., an alkylsulfonamido group and an arylsulfonamido group), a carbamoyl group (e.g., an ethylcarbamoyl group, a dimethylcarbamoyl group an N-methyl-N-phenylcarbamoyl group and an N-phenylcarbamoyl group), a sulfamoyl group (e.g., an N-alkylsulfamoyl group, an N,N-dialkylsulfamoyl group, an N-arylsulfamoyl, an N-alkyl-N-arylsulfamoyl group, and an N,N-diarylsulfamoyl group), a cyano group, a hydroxyl group, a mercapto group, a halogen atom, or a sulfo group.

$R^{1f}$ represents a hydrogen atom or groups having typically at most 32 carbon atoms, generally at most 22 carbon atoms, such as a straight or branched alkyl group, an alkenyl group, a cycloalkyl group, an aralkyl group, or a cycloalkenyl group. These groups may be substituted with a group or groups as listed for $R^{1e}$. $R^{1f}$ may be an aryl group or a heterocyclic group which may be substituted with a group or groups as listed for $R^{1e}$.

$R^{1f}$ may be a cyano group, an alkoxyl group, an aryloxy group, a halogen atom, —COOM (M=H, an alkali metal atom, $NH_4$), an alkoxycarbonyl group, an aryloxycarbonyl group, an acyloxy group, a sulfo group, a sulfamoyl group, a carbarmoyl group, an acylamino group, a diacylamino group, a ureido group, a urethane group, a sulfonamido group, an arylsulfonyl group, an alkylsulfonyl group, an urylthio group, an alkylthio group, an alkylamino group, a dialkylamino group, an anilino group, an N-aryl-anilino group, an N-alkylanilino group, an N-acylanilino group, a hydroxyl group, or a mercapto group.

$R^{1g}$ represents a group as is conventionally used in 4-equivalent phenol or α-naphthol couplers and may typically have at most 32 carbon atoms, and generally at most 22 carbon atoms.

More specifically, $R^{1g}$ represents a hydrogen atom, a halogen atom, an alkoxycarbonylamino group, an aliphatic or alicyclic-hydrocarbon group, an N-arylureido group, an acylamino group, a group —$R^{11}$ or a group —S—$R^{11}$ (wherein $R^{11}$ is an aliphatic- or alicyclic-hydrocarbon radical). When two or more of the groups of $R^{1g}$ are contained in one molecule they may be different, and the aliphatic- and alicyclic-hydrocarbon radical may be substituted. In a case that these substituents contain an aryl group, the aryl group may be substituted with a group or groups as listed for $R^{1e}$.

The aliphatic- and alicyclic-hydrocarbon radical may be saturated or unsaturated, and the aliphatic hydrocarbon may be straight or branched. Preferred examples are an alkyl group (e.g., a methyl group, an ethyl group, an isopropyl group, a butyl group, a tert-butyl group, an isobutyl group, a dodecyl group, an octadecyl group, a cyclobutyl group and a cyclohexyl group), and an alkenyl group (e.g., an alkyl group and an octenyl group). Typical examples of the aryl group are a phenyl group and a naphthyl group, and typical examples of the heterocyclic radical are a pyridinyl group, a quinolyl group, a thienyl group, a piperidyl group, and an imidazolyl group. Groups to be introduced in these aliphatic hydrocarbon radical, aryl group and heterocyclic radical include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, and a morpholino group.

p is an integer of 1 to 4.

$R^{1j}$ represents a group typically having at most 32 carbon atoms and generally at most 22 carbon atoms. $R^{1j}$ represents an arylcarbonyl group, an alkanoyl group, an alkanecarbamoyl group, an alkoxycarbonyl group, or an aryloxycarbonyl group. These groups may be substituted with groups such as an alkoxyl group, an alkoxycarbonyl group, an acylamino group, an alkylsulfamoyl group, an alkylsulfonamido group, an alkylsuccinimide group, a halogen atom, a nitro group, a carboxyl group, a nitrile group, an alkyl group, and an aryl group.

$R^{1k}$ represents groups typically having at most 32 carbon atoms, and generally at most 22 carbon atoms. $R^{1k}$ represents an arylcarbonyl group, an alkamoyl group, an arylcarbamoyl group, an alkanecarbamoyl group, an alkoxycarbonyl group, and aryloxycarbonyl group, and arylsulfonyl group, an arylsulfonyl group, an aryl group, or a 5- or 6-membered heterocyclic group (containing a hetero atom selected from a nitrogen atom, an oxygen atom, and a sulfur atom, e.g., a triazolyl group, an imidazolyl group, a phthalamido group, a succinamido group, a furyl group, a pyridyl group, and a benzotriazolyl group). These groups may be substituted with a group or groups as listed for $R^{1j}$.

The above described substituted groups in formulae 1A–1F may be further substituted repeatedly once, twice or more with a group selected from the same group of the substituents to form substituted groups having typically up to 32 carbon atoms.

Suitable examples for both the Class 1 and Class 2 LIDIRs of the invention are exemplified as follows:

A

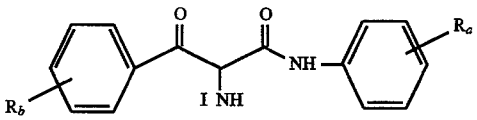

B

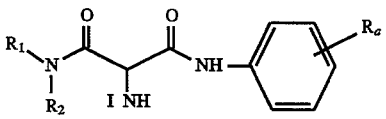

C

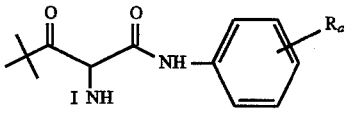

D

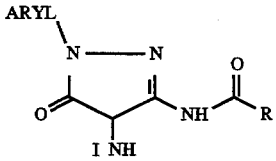

E

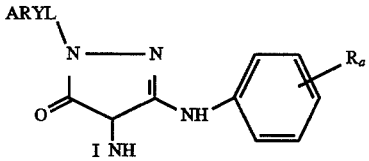

F

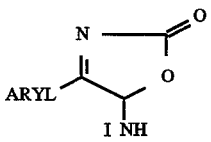

G

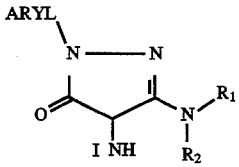

For the various parent groups, $R_a$ is preferably a 2-chloro or -alkoxy group or a 5-NHCOR, $NHSO_2R$, or an electron withdrawing group; and $R_b$ is a para alkoxy group. For group B, $R_1$ and $R_2$ may independently be alkyl, aryl and may be joined to form a ring. In group D, R may be alkyl or preferably aryl, substituted or unsubstituted. The "ARYL" groups may be substituted or unsubstituted and, for example, may suitably be phenyl, naphthyl or heterocyclic.

For the Class 1 low impact DIR couplers, typical COUP structures may typically be, for example, 1,3-dicarbonyl compounds such as acylacetamides (for example, benzoylacetamides or pivaloylacetamides), malonodiamides, malonanilides or 5-pyrazolones.

INH groups or inhibitors of silver development generally are heterocyclic compounds that have sites that are strongly adsorbed to silver. However, their ability to affect silver is greatly influenced by their substituents. One parameter used to predict whether a particular material will be a strong or weak inhibitor is Log P, as described in U.S. Pat. No. 4,782,012. Log P means the logarithm of the partition coefficient of a species between octanol and water. The color photographic element is a polyphasic system with a hydrophobic system comprising a coupler solvent containing the coupler compounds and dyes and a hydrophilic system containing the gel and silver halide. The inhibitor released in such a system will partition between these phases. Inhibitor which does not enter the hydrophilic phase to adsorb on the silver surface will not inhibit development. Log P can serve as a measure of partitioning and can be correlated to desirable inhibitor properties such as inhibition strength and inter-image effects. See U.S. Pat. No. 5,006,448 and Japanese Published Application 59/149,359. In order to simulate the conditions present in a photographic developer solution, the aqueous phase selected contains a carbonate buffer (pH=10.0, 30.0 g $K_2CO_3$ per liter). In general, moieties with a Log P=0.5 or less are weak or non-inhibitors while materials with Log P greater than 0.5 are good inhibitors.

Development inhibitor releasing couplers are described in such representative patents as U.S. Pat. Nos. 3,227,554; 3,384,657; 3,615,506; 3,617,291; 3,733.201 and U.K. Pat. No. 1,450,479. Useful INH groups for development inhibitors are iodide and heterocyclic compounds such as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, oxadiazoles, benzotriazoles, benzodiazoles, oxazoles, thiazoles, diazoles, triazoles, thiadiazoles, oxathiazoles, thiatriazoles, tetrazoles, benzimidazoles, indazoles, isoindazoles, mercaptooxazoles, mercaptothiadiazoles, mercaptothiazoles, mercaptotriazoles, mercaptooxadiazoles, mercaptodiazoles, mercaptooxathiazoles, tellurotetrazoles, or benzisodiazoles. Formulas of typical INH groups are:

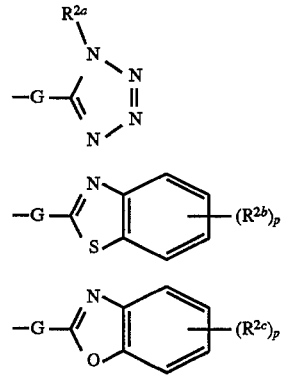

-continued

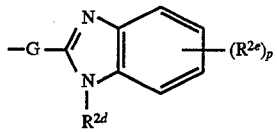

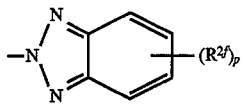

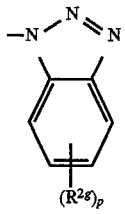

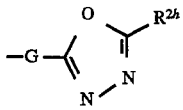

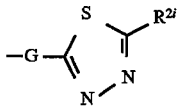

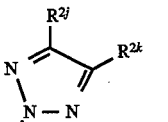

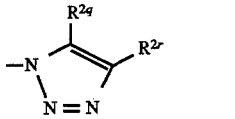

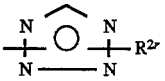

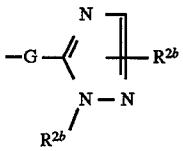

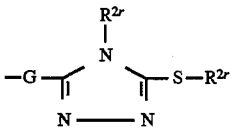

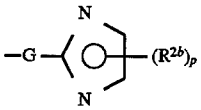

-continued

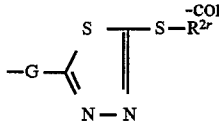

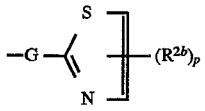

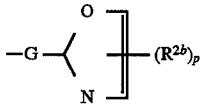

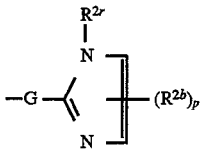

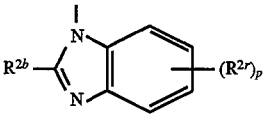

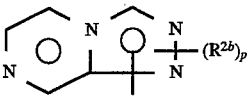

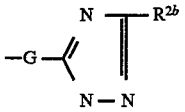

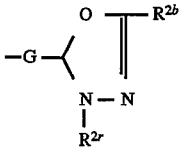

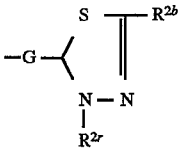

wherein:

G is S, Se, or Te, S being preferred; and wherein $R^{2a}$, $R^{2d}$, $R^{2h}$, $R^{2i}$, $R^{2j}$, $R^{2k}$, $R^{2q}$ and $R^{2r}$ are individually hydrogen, substituted or unsubstituted alkyl, straight chained or branched, saturated or unsaturated, of 1 to 8 carbon atoms such as methyl, ethyl, propyl, butyl, 1-ethylpentyl, 2-ethoxyethyl, t-butyl or i-propyl; alkoxy or alkylthio, such as methoxy, ethoxy, propoxy, butoxy, octyloxy, methylthio, ethylthio, propylthio, butylthio, or octylthiol; alkyl esters such as $CO_2CH_3$, $CO_2C_2H_5$, $CO_2C_3H_7$, $CO_2C_4H_9$, $CH_2CO_2CH_3$, $CH_2CO_2C_2H_5$, $CH_2CO_2C_3H_7$, $CH_2CO_2C_4H_9$, $CH_2CH_2CO_2CH_3$, $CH_2CH_2CO_2C_2H_5$, $CH_2CH_2CO_2C_3H_7$, and $CH_2CH_2CO_2C_4H_9$; aryl or heterocyclic esters such as $CO_2R^{2s}$, $CH_2CO_2R^{2s}$, and $CH_2CH_2CO_2R^{2s}$ wherein $R^{2s}$ is substituted or unsubstituted aryl, or a substituted or unsubstituted heterocyclic group; substituted or unsubstituted benzyl, such as methoxy-, chloro-, nitro-, hydroxy-, carboalkoxy-, carboaryloxy-, keto-, sulfonyl-, sulfonyl-, sulfenyl-, sulfinyl-, carbonamido-, sulfonamido-, carbamoyl-, or sulfamoyl-substituted benzyl; substituted or unsubstituted aryl, such as phenyl, naphthyl, or chloro-, methoxy-, hydroxy-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted phenyl. These substituents may be repeated more than once as substituents. $R^{2a}$, $R^{2d}$, $R^{2h}$, $R^{2i}$, $R^{2j}$, $R^{2k}$, $R^{2q}$ and $R^{2r}$ may also be a substituted or unsubstituted heterocyclic group selected from groups such as pyridine, pyrrole, furan, thiophene, pyrazole, thiazole, imidazole, 1,2,4-triazole, oxazole, thiadiazole, indole, benzthiophene, benzimidazole, benzoxazole and the like wherein the substitutents are as selected from those mentioned previously.

$R^{2b}$, $R^{2c}$, $R^{2e}$, $R^{2f}$, and $R^{2g}$, are as described for $R^{2a}$, $R^{2d}$, $R^{2h}$, $R^{2i}$, $R^{2j}$, $R^{2k}$, $R^{2q}$ and $R^{2r}$; or, are individually one or more halogens such as chloro, fluoro or bromo and p is 0, 1, 2, 3 or 4.

Particularly suitable INK groups are:

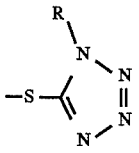

where, for Class 1 low impact DIR couplers, R is phenyl, or alkyl of up to five carbon atoms, both substituted or unsubstituted, such as ethyl, methoxyphenylethyl, hydroxyphenyl, or $—CH_2CO_2R$ ($R=C_1$ to $C_4$ alkyl), and for Class 2 R is carboxyphenyl, $—CH_2CO_2H$, $—CH_2CH_2CO_2H$, $—CH_2CH_2SO_3H^-$ $M^+$ where $M^+$ is hydrogen or a metal ion.

Also particularly suitable are INH groups of the formula:

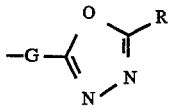

where for Class 1 DIR couplers R is phenyl or alkyl of up to five carbon atoms and for Class 2 DIR couplers R is methyl.

For class 1 DIR couplers INH can be any inhibitor fragment. (Log P is not a factor here because INH is not released during processing). Preferred INH groups contain sulfur (such as mercaptotetrazole, mercaptooxadiazole, etc.)

A "Class 2" DIR coupler has the same formula as a Class 1 DIR coupler and is any coupler which releases an inhibitor-like fragment which does not substantially affect silver development. (Contrast reduction less than 25%.) It must contain an ionizable hydrogen at the site at which INH is attached. For a Class 2 low impact DIR coupler, COUP may be any such group described earlier for Class 1 DIRs but without limitation as to pK. Suitably, the coupler is chosen from 1,3-dicarbonyl compounds such as acylacetamides (for example, benzoylacetamides or pivaloylacetamides), malonodiamides, malonanilides or 5-pyrazolones. For Class 2, INH is any inhibiting group whose Log P is 0.5 or less. Desirable species of INH contain sulfur and an ionizable solubilizing group such as a carboxylic or sulfonic acid.

Specific examples of low impact DIR couplers useful in the invention are as follows:

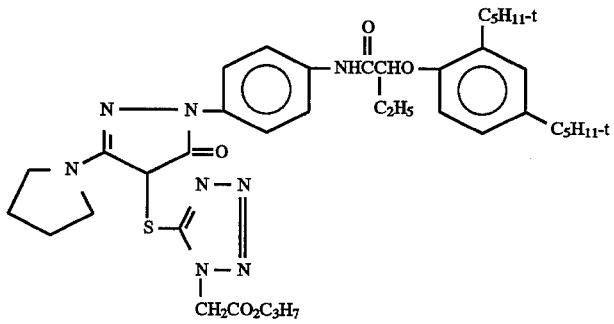

LI-1

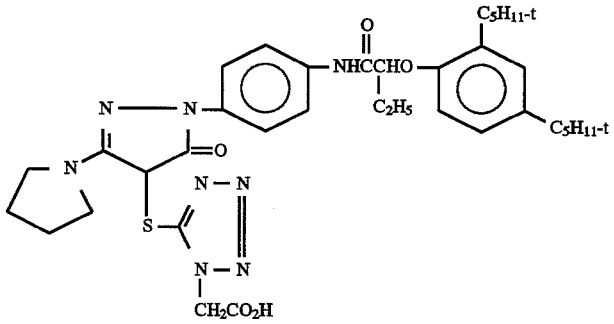

LI-2

-continued
LI-3
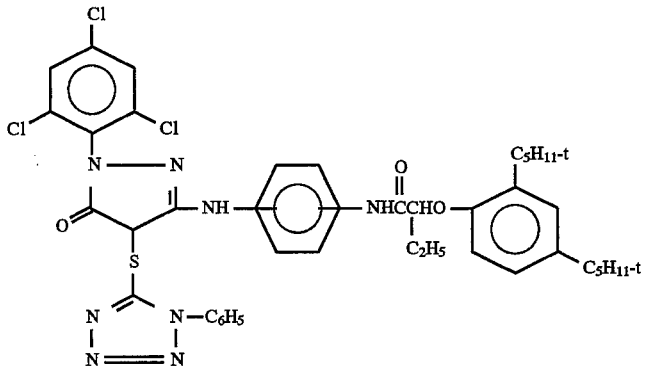
LI-4
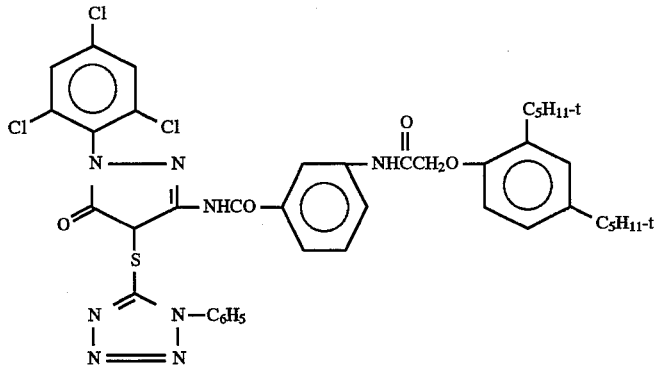
LI-5
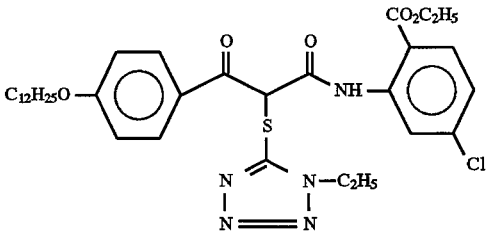
LI-6
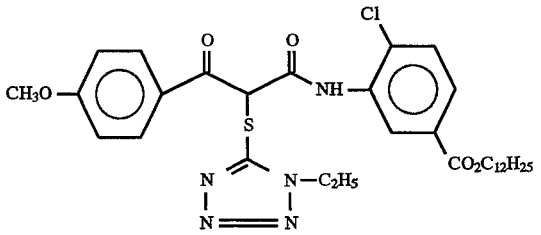
LI-7
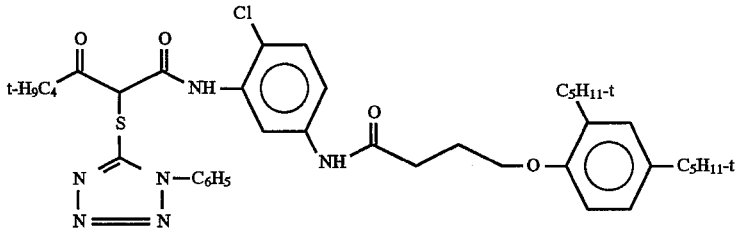

-continued

LI-8

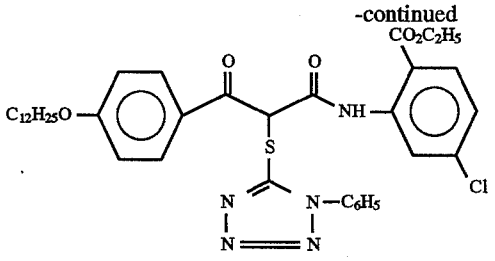

It has been found that the presence of the low impact DIR's provide significant improvements in the keeping characteristics of the element as measured by lessened Dmin (fog) and by better maintenance of Dmax (coupler stability) when compared to the same photographic element without the DIR of the invention. With low impact DIR's, these advantages can be accomplished without undue loss in contrast as measured by gamma. Contrast losses are less than 20% compared to 60% or more where a conventional DIR is employed.

The materials of this invention can be used in any of the ways and in any of the combinations in which such materials are used in the photographic art. Typically, they are incorporated in a silver halide emulsion layer and the emulsion layer coated on a support to form part of a photographic element.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a masking coupler of this invention. The element can contain additional layers, such as filter layers, interlayers, overcoat layers, subbing layers, and the like.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-D-(methanesulfonamido)ethyl-N,N-diethylaniline hydrochloride and 4-amino-N-ethyl-N-(2-methoxyethyl)-m-toluidine di-p-toluene sulfonic acid.

The materials described herein may be used in combination with other types of couplers such as enamines, 3-acylamino- or 3-anilino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. No. 4,301,235; U.S. Pat. No. 4,853,319 and U.S. Pat. No. 4,351,897. The coupler may also be used in association with yellow or cyan colored couplers (e.g. to adjust levels of interlayer correction) and with other masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

For example, the materials of the invention may be included in a magenta layer or may be added to one or more of the other layers in a color negative photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3- ((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5-[(2,2,3,3, 4,4,4-heptafluoro-1-oxobutyl)amino]-4-hydroxyphenoxy]-2,3-dihydroxy-6-[(propylamino) carbonyl] phenyl]thio]-1,3,4-thiadiazol-2-yl]thio]-, methyl est and "Coupler 3": 1-((dodecyloxy)carbonyl) ethyl(3- chloro-4-((3-(2-chloro-4-((1-tridecanoylethoxy)carbonyl)anilino)-3-oxo-2-((4)(5)(6)-(phenoxycarbonyl)-1H-benzotriazol-1-yl) propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl) amino)carbonyl)-5-hydroxy-1-naphthalenyl)-, 2-methylpropyl ester, "Coupler 7": Acetic acid, ((2-((3-(((3-(dodecyloxy)propyl) amino)carbonyl)- 4-hydroxy-8-(((2-methylpropoxy) carbonyl) amino)-1-naphthalenyl)oxy )ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": 2-Propenoic acid, butyl ester, styrene , 2:1:1 polymer with (N[1-(2,4,6-trichlorophenyl)-4,5-dihydro-5-oxo-1H-pyrazol-3-yl]-2-methyl-2-propenamide)$_2$ and "Coupler 10": Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis (1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

The couplers may also be used in association with materials that accelerate or otherwise modify the processing steps e.g. of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is use of the coupler in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The couplers may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The coupler may further be used in combination with image-modifying compounds such as "Developer Inhibitor-Releasing" compounds (DIR's). DIR's useful in conjunction with the couplers of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

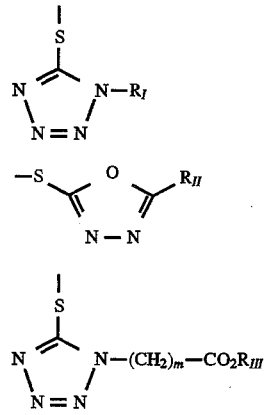

-continued

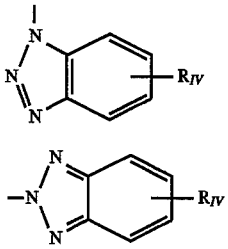

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and $—SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $—COOR_V$ and $—NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

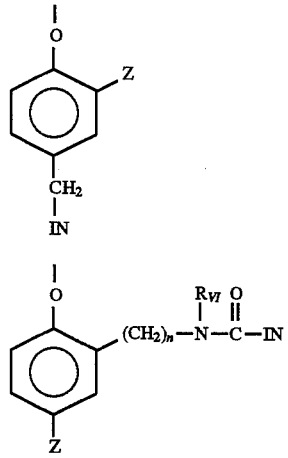

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

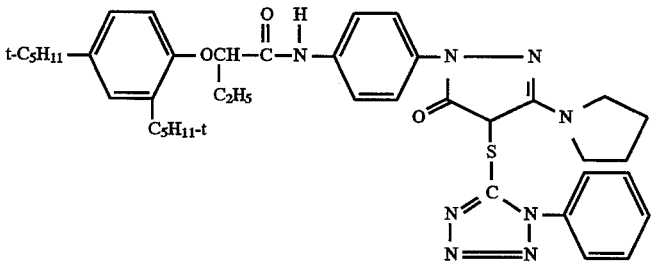

D2

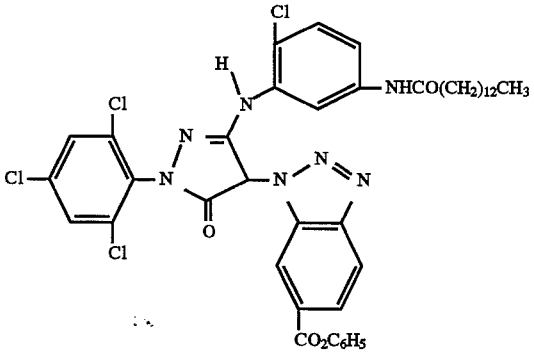

-continued
D3
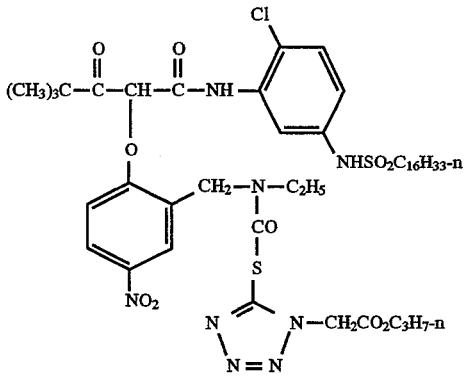
D4
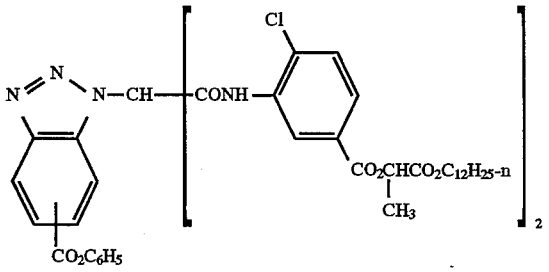
D5
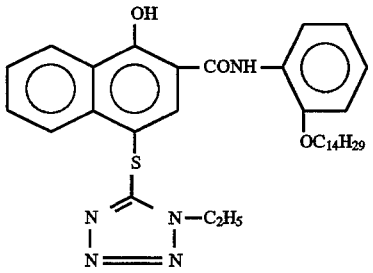
D6
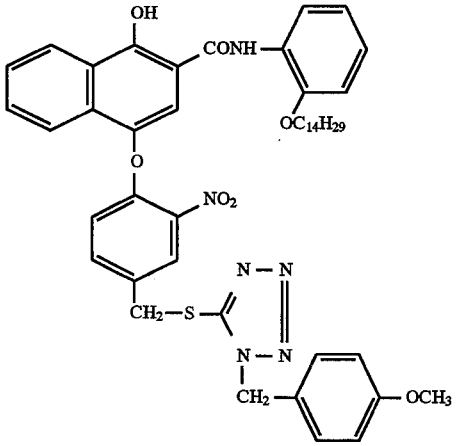

-continued

D7

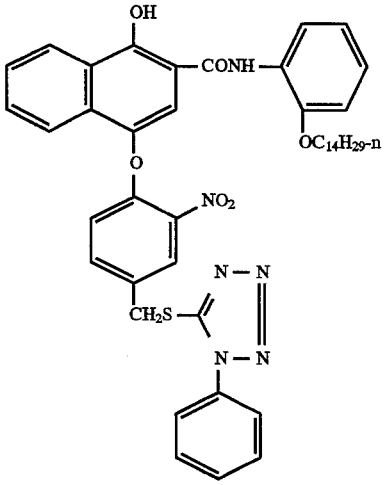

D8

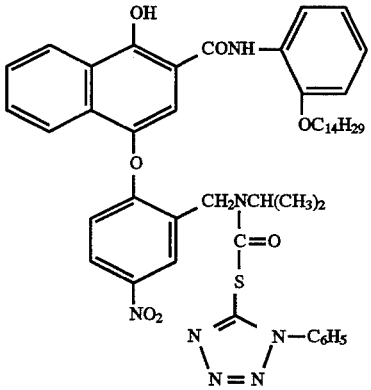

D9

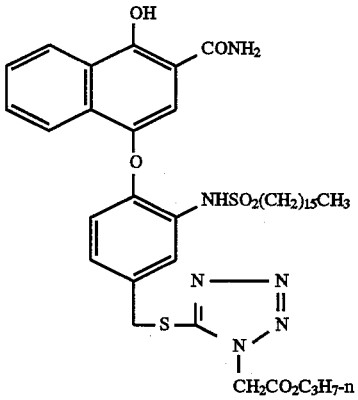

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range upto about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or internal latent images predominantly in the interior of the silver halide grains. The emulsions can be negative-working emulsions, such as surface-sensitive emulsions or unfogged internal latent image-forming emulsions.

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in, for example, the British Journal of Photography Annual of 1988, pages 191–198.

Development is followed by the conventional steps of bleaching, fixing, or bleach-fixing, to remove silver or silver halide, washing, and drying.

The bicyclic azole, masking, and low impact DIR couplers can be prepared using any of the methods well-known in the art as described, for example, in Section VII of Research Disclosure, and for example in the following patents: European Patent 285,274; PCT published application WO 92/12,464; U.S. Pat. Nos. 2,852,370; 3,005,712; 3,725,067; 4,277,559; and 4,540,654.

Photographic Examples and Comparisons

For the examples summarized in Table I, the compounds employed were as identified in the foregoing examples of image couplers, colored masks, and low impact DIR couplers. The conventional comparison DIR coupler had the formula:

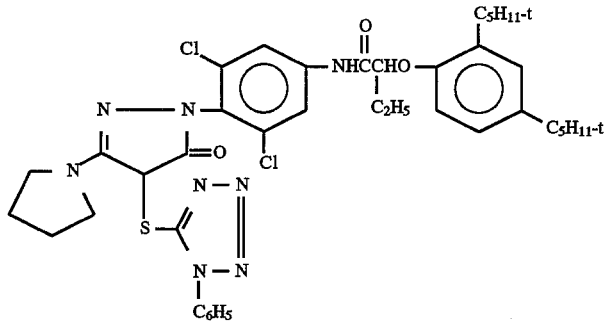

For each of the examples and comparisons, photographic elements were prepared as follows:

Single layer photographic elements were prepared by coating a cellulose acetate-butyrate film support (with a rem-jet antihalation backing) with a photosensitive layer containing a silver bromoiodide emulsion at 1.08 g/m$^2$, gelatin at 2.69 g/m$^2$ and an image coupler dispersed in an equal weight of tricresylphosphate at 0.43 g/m$^2$, an azopyrazolone masking coupler dispersed in an equal weight of tricresylphosphate at 0.108 g/m$^2$ and, when present, an inhibitor releasing coupler-dispersed in twice its weight in N,N-dibutyllauramide at 0.054 g/m$^2$.

The photosensitive layer was overcoated with a layer containing gelatin at 5.38 g/m$^2$ and bis-vinylsulfonyl methyl ether hardener at 1.75 weight percent based on total gel. Samples of each element were exposed imagewise through a stepped density test object and subjected to the Kodak Flexicolor (C-41) process as described in *British Journal of Photography Annual*, 1988, pp. 196–198. Gamma is the maximum slope between any two exposure steps and is a measure of activity.

Separate samples were then placed either in the freezer (0° C.) or incubated at 38° C. and 50% relative humidity for a two week period. For purposes of determining the keeping properties, the freezer and incubated samples were then compared by measuring the Dmin of the samples and determining the difference between the incubated and freezer samples; also, Dmax was measured for the freezer and incubated samples, and the % increase or decrease of the incubated sample versus the freezer sample determined. Good keeping is indicated by lower values for Delta Dmin (which indicates smaller increases in the fog level) and by lower % loss in Dmax (which indicates a smaller rate of image coupler degradation.)

The loss in contrast occasioned by the DIR is measured by determining in the conventional manner the gamma value for the freezer samples and expressing the loss in contrast as a % loss in contrast from the sample containing no DIR. Table 1 shows the make-up of the elements tested and the detailed results. Table II summarizes the results for clearer analysis.

TABLE I

Keeping and Contrast Results

| Experiment | Type | Image Coupler | Masking Coupler | DIR | Activity-Fresh Gamma (Dir vs No DIR) ΔGamma (%) | Keeping for 2 Weeks 37.8° C./50% Humidity ΔDmin | ΔDmax (%) | Activity 2 Weeks Freezer ΔGamma (%) |
|---|---|---|---|---|---|---|---|---|
| 1A | Comp. | M-15 | CM-5 | NO DIR | — | .308 | −25.6 | — |
| 1B | Comp. | M-15 | CM-5 | C-1 | −58.0 | .226 | −5.4 | −54.7 |
| 1C | Inv. | M-15 | CM-5 | LI-1 | −18.4 | .357 | −3.8 | −18.4 |
| ID | Inv. | M-15 | CM-5 | LI-2 | +6.4 | .381 | −4.8 | +6.4 |
| IE | Inv. | M-15 | CM-5 | LI-3 | −2.3 | .213 | −15.3 | −2.3 |
| IF | Inv. | M-15 | CM-5 | LI-4 | −1.5 | .289 | −3.6 | −1.4 |
| INV. AVG.* | | | | | | .310 | −6.9 | −3.9 |
| 2A | Comp. | M-15 | CM-3 | NO DIR | — | .472 | −2.5 | |
| 2B | Comp. | M-15 | CM-3 | C-1 | −62.8 | .216 | −9.5 | −62.8 |
| 2C | Inv. | M-15 | CM-3 | LI-5 | −9.1 | .431 | −1.8 | −9.1 |
| 2D | Inv. | M-15 | CM-3 | LI-2 | +7.3 | .375 | −2.1 | +7.3 |
| 2E | Inv. | M-15 | CM-3 | LI-3 | −3.2 | .333 | −4.3 | −3.2 |
| 2F | Inv. | M-15 | CM-3 | LI-4 | −10.6 | .302 | −2.2 | −10.6 |
| INV. AVG.* | | | | | | .360 | −2.6 | −3.9 |
| 3A | Comp. | M-20 | CM-5 | NO DIR | — | .220 | −1.7 | — |
| 3B | Comp. | M-20 | CM-5 | C-1 | −54.1 | .127 | −11.6 | −54.1 |
| 3C | Inv. | M-20 | CM-5 | LI-5 | −1.5 | .163 | 0.3 | −1.5 |
| 3D | Inv. | M-20 | CM-5 | LI-2 | +9.1 | .201 | 4.8 | +9.2 |
| 3E | Inv. | M-20 | CM-5 | LI-4 | −6.6 | .114 | 5.0 | −6.6 |
| INV. AVG.* | | | | | | .159 | 3.4 | +.4 |
| 4A (avg. of 2) | Comp. | M-15 | CM-5 | NO DIR | — | .71 | −11.8 | — |
| 4B | Comp. | M-15 | CM-5 | C-1 | −51.9 | .47 | −7.2 | 48.1 |
| 4C | Inv. | M-15 | CM-5 | LI-7 | −11.7 | .68 | −5.4 | 11.7 |
| 4D | Inv. | M-15 | CM-5 | LI-5 | −5.2 | .75 | −4.3 | −5.0 |
| 4E | Inv. | M-15 | CM-5 | LI-6 | −10.3 | .74 | −1.8 | −9.3 |
| INV. AVG.* | | | | | | .72 | −3.8 | −8.7 |
| 5A (avg. of 2) | Comp. | M-14 | CM-5 | NO DIR | — | .04 | −1.0 | — |
| 5B | Comp. | M-14 | CM-5 | C-1 | −62.4 | .02 | −3.8 | −62.4 |
| 5C | Inv. | M-14 | CM-5 | LI-8 | −22.3 | .03 | −1.1 | −22.3 |
| 6A (avg. of 2) | Comp. | M-15 | CM-5 | NO DIR | — | .08 | −10.4 | — |
| 6B | Comp. | M-15 | CM-5 | C-1 | −45.8 | .06 | −1.9 | −45.8 |
| 6C | Inv. | M-15 | CM-5 | LI-8 | −12.2 | .08 | +.1 | −12.1 |

*INV. AVG. is the average of the invention values for a given experiment

TABLE II

Summary of Results

| Experiment | Improvement in Density Change (From Table I Data) Improvement in ΔDmin | Improvement in ΔDmax - (%) | Improvement in ΔGamma - (%) |
|---|---|---|---|
| 1 - Inv vs No DIR | −.002 | +18.7 | — |
| 1 - Inv vs DIR C-1 | −.084 | −1.5 | +50.8 |
| 2 - Inv vs No DIR | +.112 | −0.1 | — |
| 2 - Inv vs DIR C-1 | +.144 | +6.9 | +58.9 |
| 3 - Inv vs No DIR | +.061 | +5.1 | — |
| 3 - Inv vs DIR C-1 | −.032 | +15.0 | +54.5 |
| 4 - Inv vs No DIR | −.01 | +8.0 | — |
| 4 - Inv vs DIR C-1 | −.25 | +3.4 | +56.8 |

TABLE II-continued

Summary of Results

| Experiment | Improvement in Density Change (From Table I Data) Improvement in ΔDmin | Improvement in ΔDmax - (%) | Improvement in ΔGamma - (%) |
|---|---|---|---|
| 5 - Inv vs No DIR | +.01 | −0.1 | — |
| 5 - Inv vs DIR C-1 | −.01 | +2.7 | +40.1 |
| 6 - Inv vs No DIR | 0.0 | +10.5 | — |
| 6 - Inv vs DIR C-1 | −.02 | +2.0 | +33.7 |

The results of the testing are shown in Table II. It is clear that the element of the invention has improved keeping as measured by Dmin increase and by Dmax loss compared to the elements containing no DIR. Further, the low impact DIR accomplishes the improvement without the massive loss in initial contrast that is evidence by the use of a highly reactive DIR, thus allowing for granularity improvements by coupler starvation techniques.

What is claimed is:

1. A photographic element comprising a support bearing a light-sensitive photographic silver halide layer containing (1) a bicyclic azole coupler (2) an azopyrazolone masking coupler and (3) a low impact development inhibitor releasing (LIDIR) coupler having at least one hydrogen atom at the coupling site and which does not substantially reduce contrast in the layer in which it is coated.

2. The element of claim 1 wherein the LIDIR coupler exhibits a $pK_a$ of 8.0 or less.

3. The element of claim 2 wherein the LIDIR coupler contains a parent and a coupling-off group having an inhibitor fragment, wherein the parent is selected from the group consisting of acylacetamides, malonodiamides, malonanilides and 5-pyrazolones.

4. The element of claim 1 wherein the LIDIR coupler contains a coupling-off group having a log P of 0.5 or less.

5. The element of claim 4 wherein the LIDIR coupler contains a parent and a coupling-off group having an inhibitor fragment, wherein the parent is selected from the group consisting of acylacetamides, malonodiamides, malonanilides and 5-pyrazolones.

6. The element of claim 1 wherein the LIDIR coupler contains a parent and a coupling-off group having an inhibitor fragment, wherein the parent is selected from the group consisting of acylacetamides, malonodiamides, malonanilides and 5-pyrazolones.

7. The element of claim 4 wherein the LIDIR contains an inhibitor fragment selected from the group consisting of

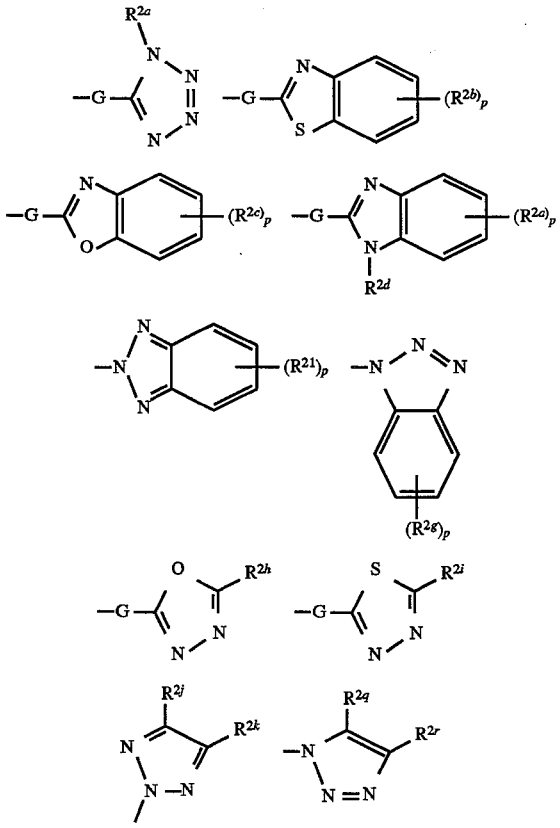

-continued

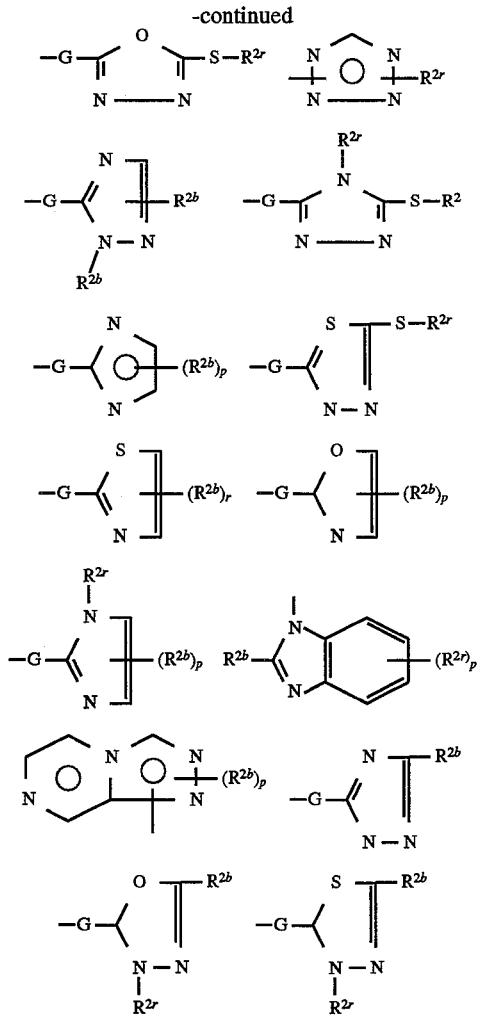

wherein

G is S, Se, or Te, and $R^{2a}$, $R^{2d}$, $R^{2h}$, $R^{2i}$, $R^{2j}$, $R^{2k}$, $R^{2q}$ and $R^{2r}$ are individually hydrogen, substituted or unsubstituted alkyl, straight chained or branched, saturated or unsaturated, of 1 to 8 carbon atoms; alkoxy; alkythio; alkyl esters; aryl or heterocyclic esters; a substituted or unsubstituted heterocyclic group; substituted or unsubstituted benzyl; substituted or unsubstituted aryl, which substituents may be repeated more than once as substituents;

$R^{2b}$, $R^{2c}$, $R^{2e}$, $R^{2f}$, and $R^{2g}$, are selected from the group as described for $R^{2a}$, $R^{2d}$, $R^{2h}$, $R^{2i}$, $R^{2j}$, $R^{2k}$, $R^{2q}$ and $R^{2r}$; or are individually halogen; and is 0, 1, 2, 3 or 4.

8. The element of claim 7 wherein the inhibitor fragment is selected from the group consisting of

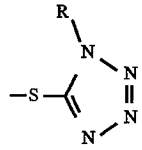

wherein, R is phenyl, or alkyl of up to five carbon atoms, either substituted or unsubstituted, and

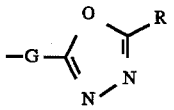

wherein G is S, Se or Te; and R is phenyl or alkyl of up to five carbon atoms.

9. The element of claim 8 wherein the LIDIR coupler contains a parent and a coupling-off group having an inhibitor fragment, wherein the parent is selected from the group consisting of acylacetamides, malonodiamides, malonanilides and 5-pyrazolones.

10. The element of claim 7 wherein the bicyclic azole coupler has a formula selected from the group consisting of:

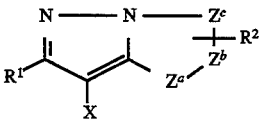

IA or

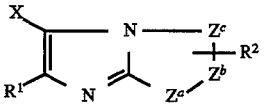

IB wherein:

$R^1$ and $R^2$ are substituents;

X is hydrogen or a coupling-off group; $Z^a$, $Z^b$ and $Z^c$ are independently selected from the group consisting of a substituted or unsubstituted methine group, =N—, =C— or —NH—, provided that one of either the $Z^a$—$Z^b$ bond or the $Z^b$—$Z^c$ bond is a double bond and the other is a single bond, and when the $Z^b$—$Z^c$ bond is a carbon-carbon double bond, it may form part of an aromatic ring.

11. The element of claim 10 wherein the bicyclic azole coupler is selected from the group consisting of 1-H-pyrazolo [3,2-c] [1,2,4] triazoles and 1-H-pyrazolo [1, 5-b] [1,2,4] triazoles.

12. The element of claim 7 wherein the bicyclic azole coupler is selected from the group consisting of:

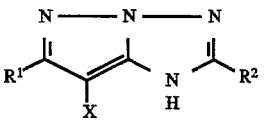

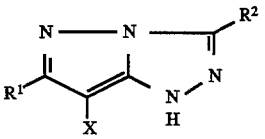

-continued

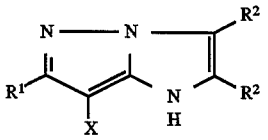

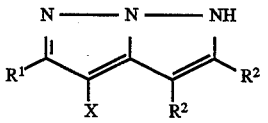

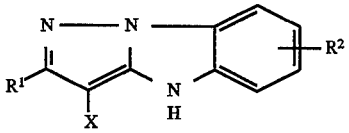

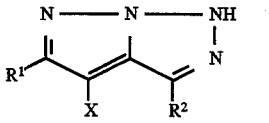

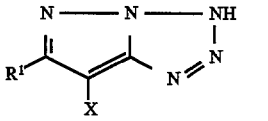

and

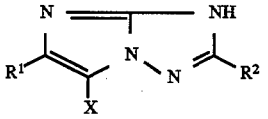

wherein:

$R^1$ and $R^2$ are substituents;

X is hydrogen or a coupling-off group.

13. The element of claim 12 wherein the LIDIR coupler contains a parent and a coupling-off group having an inhibitor fragment, wherein the parent is selected from the group consisting of acylacetamides, malonodiamides, malonanilides and 5-pyrazolones.

14. The element of claim 7 wherein the LIDIR coupler contains a parent and a coupling-off group having an inhibitor fragment, wherein the parent is selected from the group consisting of acylacetamides, malonodiamides, malonanilides and 5-pyrazolones.

15. The element of claim 1 wherein the LIDIR fragment is selected from the group consisting of

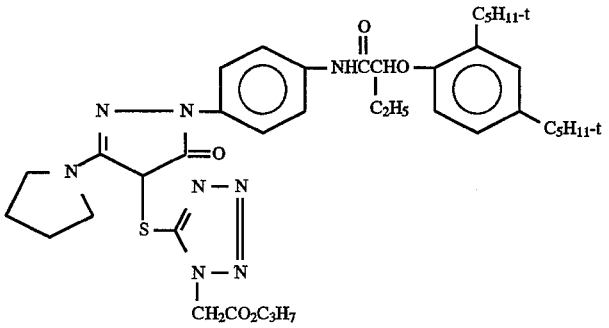
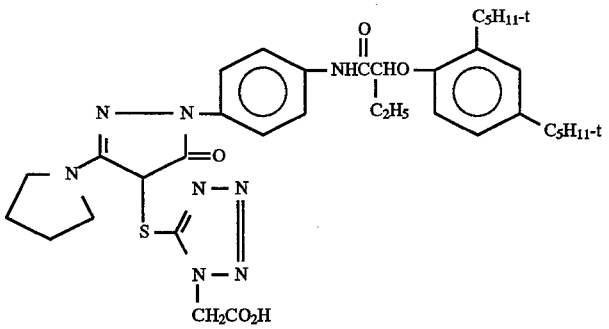
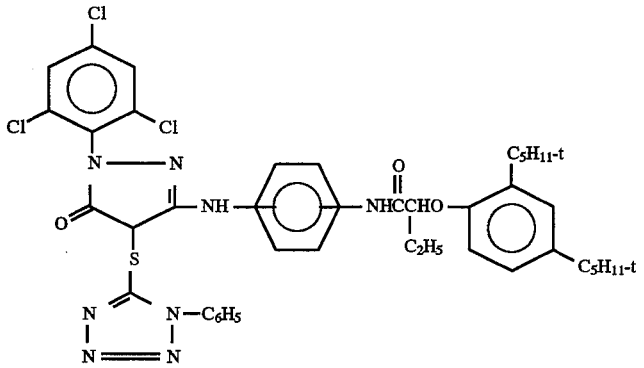
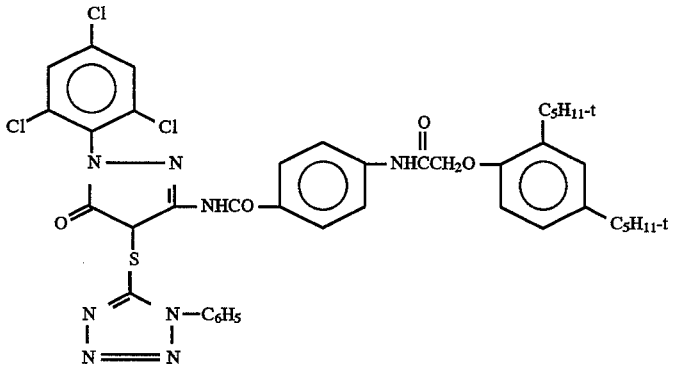
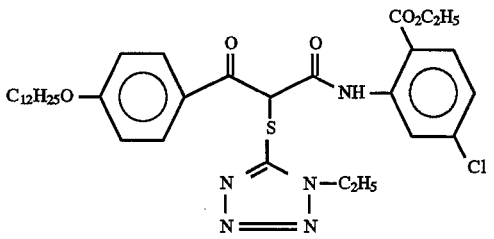

-continued

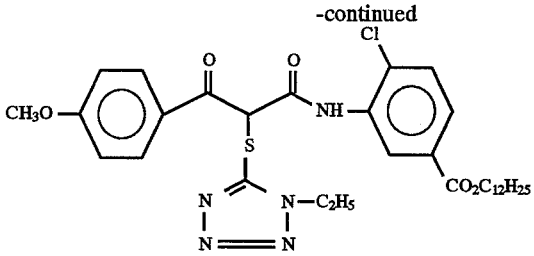

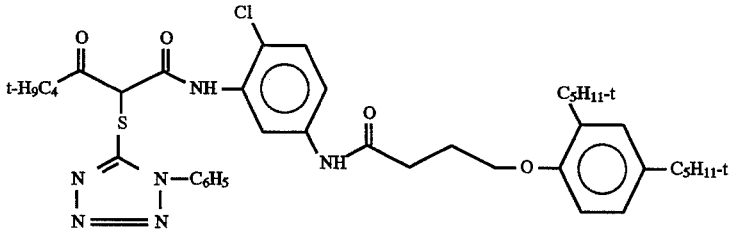

and

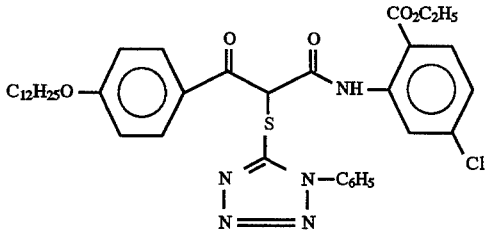

16. The element of claim 1 wherein the bicyclic azole coupler comprises a parent and, at the coupling-off position, hydrogen or a coupling-off group wherein the parent is selected from the group consisting

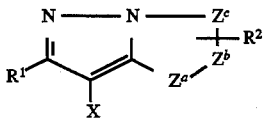

IA and

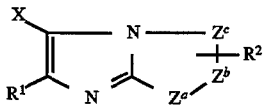

IB wherein $R^1$ and each $R^2$ are independently hydrogen or substituents that do not adversely affect the coupling action of the coupler; X is hydrogen or a coupling-off group; and $Z^a$, $Z^b$ and $Z^c$ are independently selected from the group consisting of a substituted or unsubstituted methine group, =N-, =C— or —NH—, provided that one of either the $Z^a$—$Z^b$ bond or the $Z^b$—$Z^c$ bond is a double bond and the other is a single bond, and when the $Z^b$—$Z^c$ bond is a carbon-carbon double bond, it may form part of an aromatic ring.

17. The element of claim 1 wherein the azopyrazolone masking coupler has the formula:

Cp—N=N—$R_3$ wherein, Cp represents a 5-pyrazolone magenta coupler residual group wherein the azo group is attached at the 4-position of the magenta coupler, and $R_3$ represents a substituted or unsubstituted aryl group.

18. The element of claim 17 wherein Cp of the masking coupler has the formula:

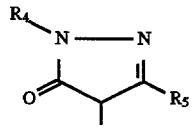

wherein $R_4$ represents a substituted or unsubstituted aryl group and $R_5$ represents a substituted or unsubstituted acylamino group, anilino group, ureido group or carbamoyl group.

19. The element of claim 18 wherein the LIDIR coupler contains a parent and a coupling-off group having an inhibitor fragment, wherein the parent is selected from the group consisting of acylacetamides, malonodiamides, malonanilides and 5-pyrazolones.

20. A process for forming a photographic image comprising developing an exposed element as defined in claim 1 with a color developing agent.

* * * * *